US012722246B2

(12) United States Patent
Yun et al.

(10) Patent No.: US 12,722,246 B2
(45) Date of Patent: Sep. 1, 2026

(54) POLISHING PAD AND METHOD FOR MANUFACTURING SEMICONDUCTOR DEVICE USING THE SAME

(71) Applicant: SK enpulse Co., Ltd., Gyeonggi-do (KR)

(72) Inventors: Sung Hoon Yun, Seoul (KR); Jang Won Seo, Seoul (KR); Hye Young Heo, Gyeonggi-do (KR); Jong Wook Yun, Seoul (KR); Jae In Ahn, Gyeonggi-do (KR)

(73) Assignee: ENPULSE CO., LTD., Chungcheongnam-do (KR)

( * ) Notice: Subject to any disclaimer, the term of this patent is extended or adjusted under 35 U.S.C. 154(b) by 694 days.

(21) Appl. No.: 17/856,649

(22) Filed: Jul. 1, 2022

(65) Prior Publication Data

US 2023/0059394 A1 Feb. 23, 2023

(30) Foreign Application Priority Data

Jul. 2, 2021 (KR) ..... 10-2021-0087103
Oct. 12, 2021 (KR) ..... 10-2021-0134606

(51) Int. Cl.
*B24B 37/24* (2012.01)
*B24B 37/20* (2012.01)
(Continued)

(52) U.S. Cl.
CPC ..... *B24B 37/24* (2013.01); *B24B 37/205* (2013.01); *B24B 37/22* (2013.01); *B24B 37/26* (2013.01)

(58) Field of Classification Search
CPC ..... B24B 37/22; B24B 37/24; B24B 37/26; B24B 37/205; B24D 18/0072
(Continued)

(56) References Cited

U.S. PATENT DOCUMENTS 6,884,904 B2 * 4/2005 Smith ..... C08G 18/10 528/65
7,871,309 B2 * 1/2011 Ogawa ..... B24B 37/205 451/527
(Continued)

FOREIGN PATENT DOCUMENTS

JP 2019093543 A 6/2019
KR 10-2009-0130147 A 12/2009
(Continued)

OTHER PUBLICATIONS

Office Action for Chinese Patent Application No. 202210769545.3 issued by the Chinese Patent Office on Oct. 31, 2024.
(Continued)

*Primary Examiner* — Brian D Keller
*Assistant Examiner* — Marcel T Dion
(74) *Attorney, Agent, or Firm* — IP & T GROUP LLP

(57) ABSTRACT

Provided are a polishing pad provided with a structural feature capable of maximizing the leakage prevention effect, the polishing pad including: a polishing layer including a first surface which is a polishing surface and a second surface which is an opposite surface thereof, and including a first through hole passing through the first surface and the second surface; a window disposed in the first through hole; and a support layer disposed at the second surface of the polishing layer.

14 Claims, 10 Drawing Sheets

(51) Int. Cl.
*B24B 37/22* (2012.01)
*B24B 37/26* (2012.01)

(58) Field of Classification Search
USPC ..... 451/527, 533, 534
See application file for complete search history.

(56) References Cited

U.S. PATENT DOCUMENTS 8,087,975 B2 * 1/2012 Feng ..... B32B 27/32 451/41
2009/0253353 A1 10/2009 Ogawa et al.
2014/0213151 A1 * 7/2014 Kimura ..... H01L 21/304 451/527
2014/0357170 A1 * 12/2014 Qian ..... B24B 37/22 451/527
2015/0273652 A1 * 10/2015 Qian ..... B24B 37/205 451/529
2017/0246722 A1 * 8/2017 Hu ..... B24B 37/24
2018/0043498 A1 * 2/2018 Norimoto ..... B24B 37/015
2019/0111542 A1 * 4/2019 Yun ..... B24B 37/205
2019/0152017 A1 5/2019 Hu et al.
2020/0164483 A1 5/2020 Yun et al.
2020/0353586 A1 * 11/2020 Moyer ..... B24B 37/26

FOREIGN PATENT DOCUMENTS

KR 10-2019-0006699 A 1/2019
KR 10-2019-0114264 A 10/2019
TW 201729940 A 9/2017
TW 201808529 A 3/2018
TW I698306 B 7/2020
TW 202103852 A 2/2021
TW 202112864 A 4/2021

OTHER PUBLICATIONS

Office Action on the Korean Patent Application No. 10-2021-0134606 issued by the Korean Patent Office on Jul. 4, 2023.
Office Action for the Taiwanese Patent Application No. 111124670 issued by the Taiwanese Patent Office on May 4, 2023.

* cited by examiner

[FIG. 1]
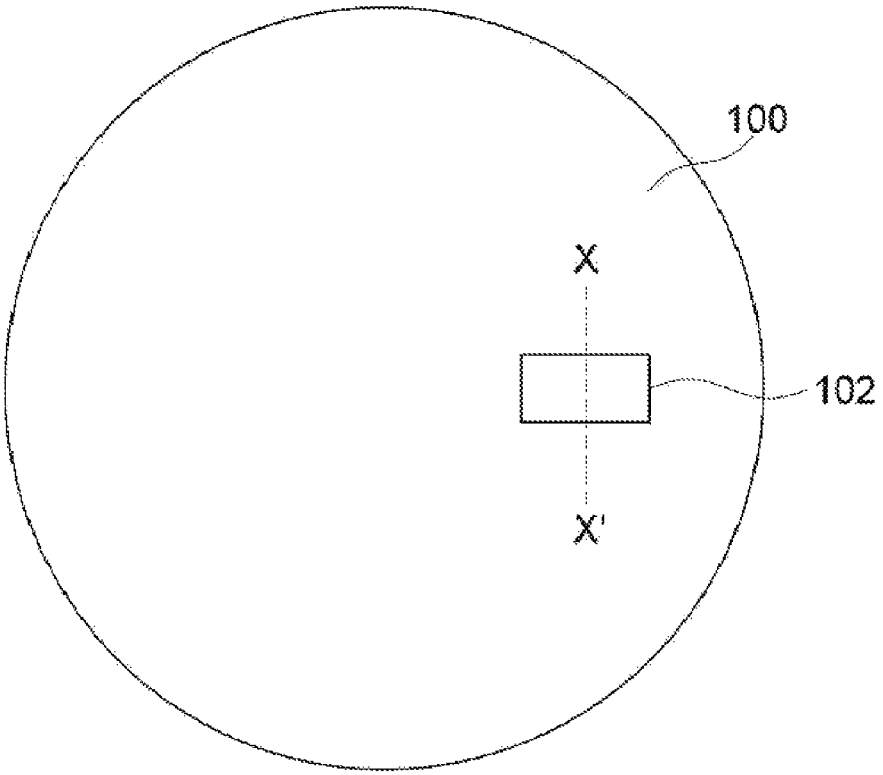

[FIG. 2]
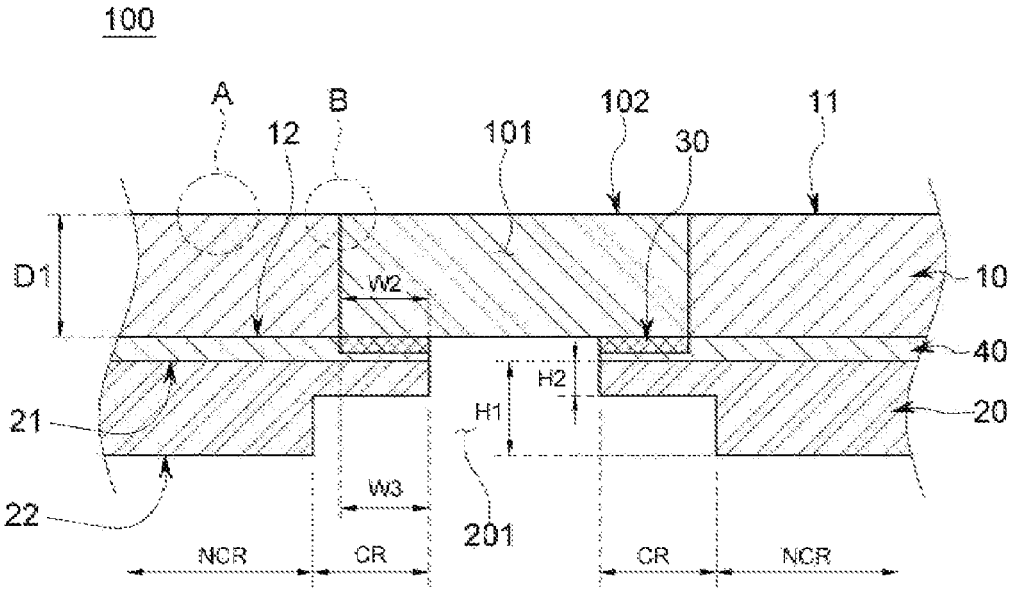

[FIG. 3]
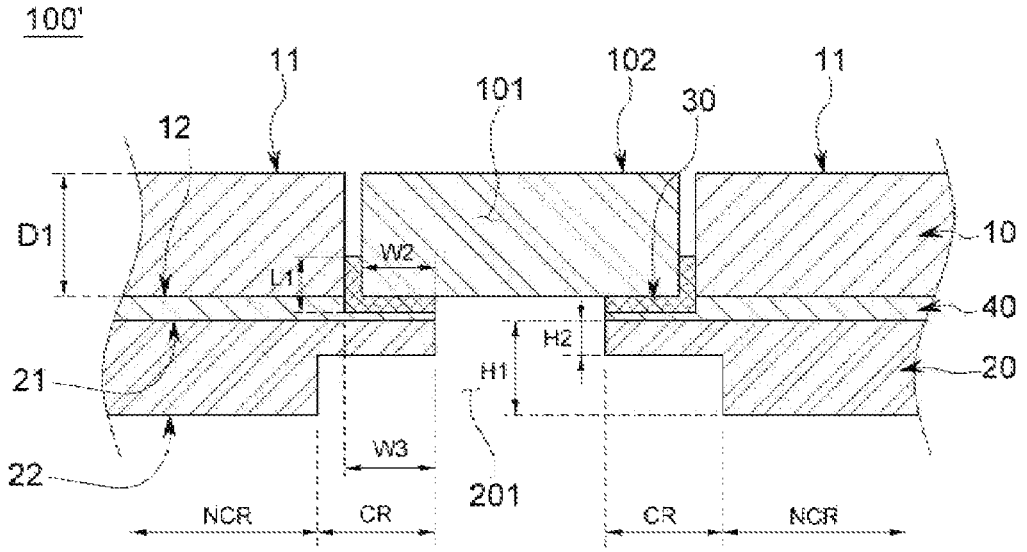

[FIG. 4]
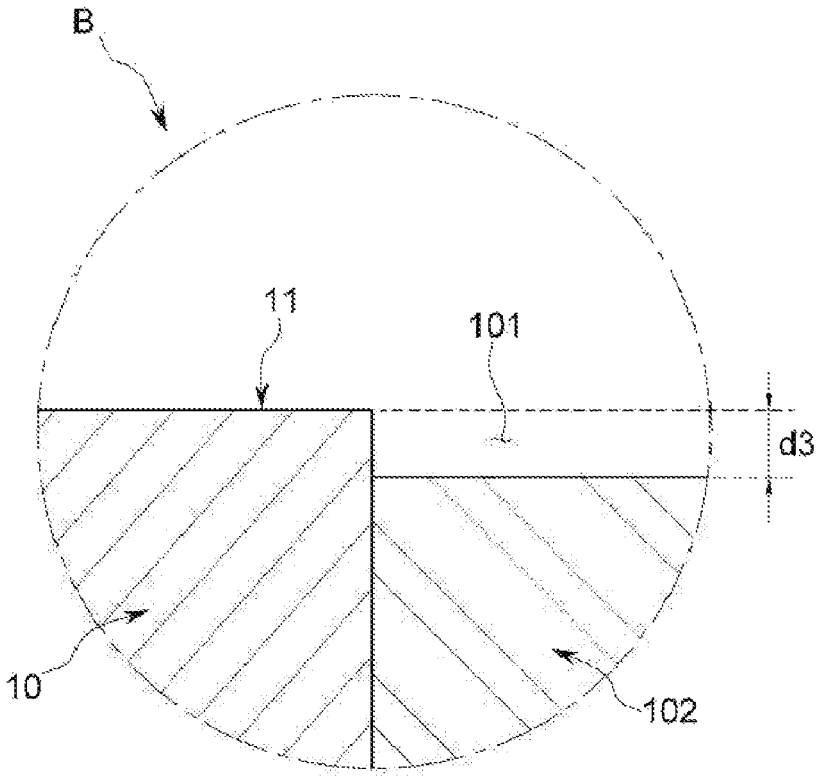

[FIG. 5]
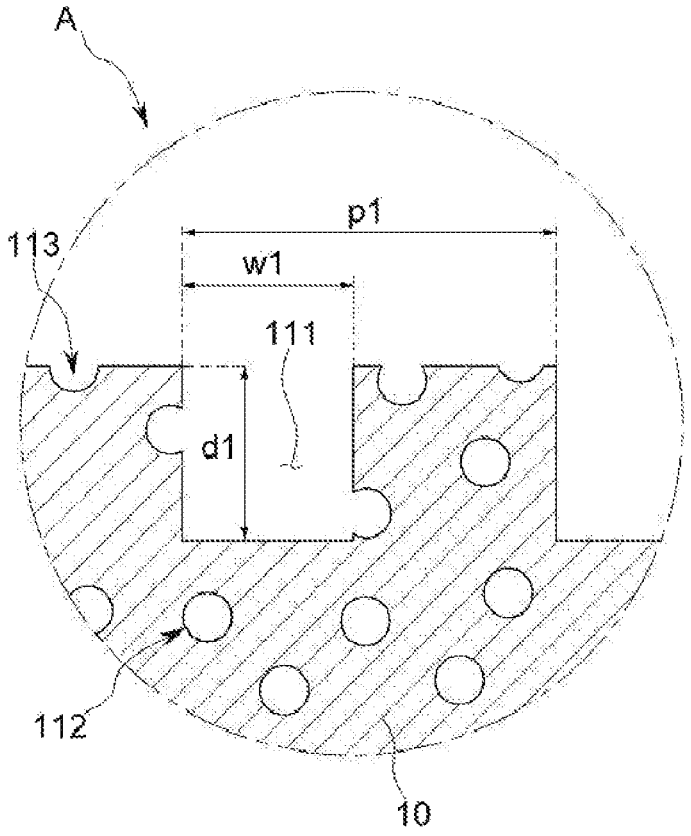

[FIG. 6]
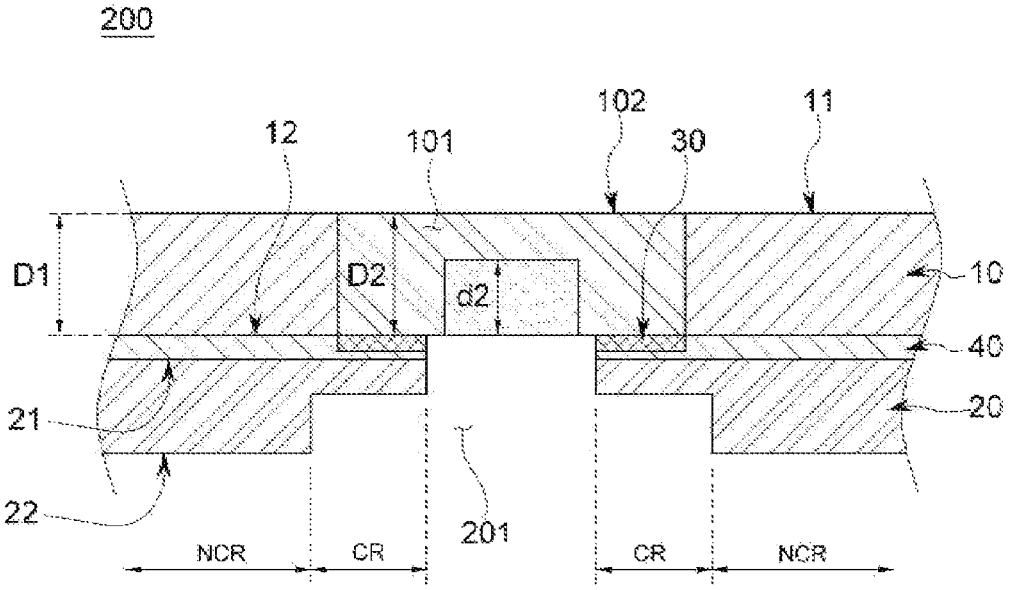

[FIG. 7]
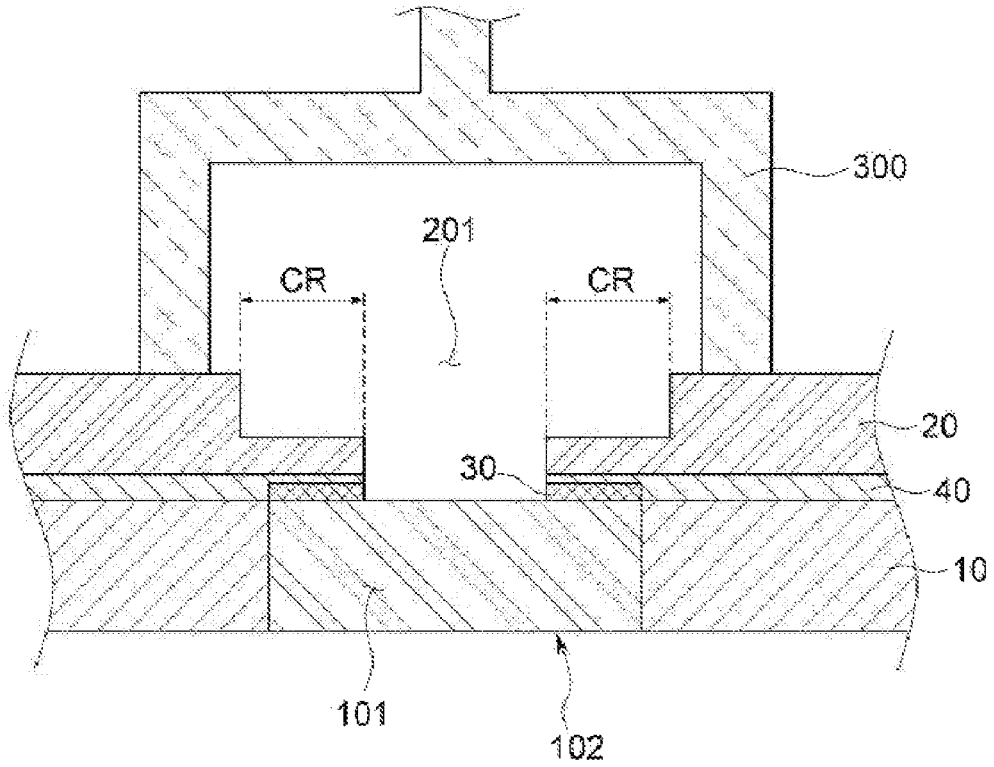

[FIG. 8]
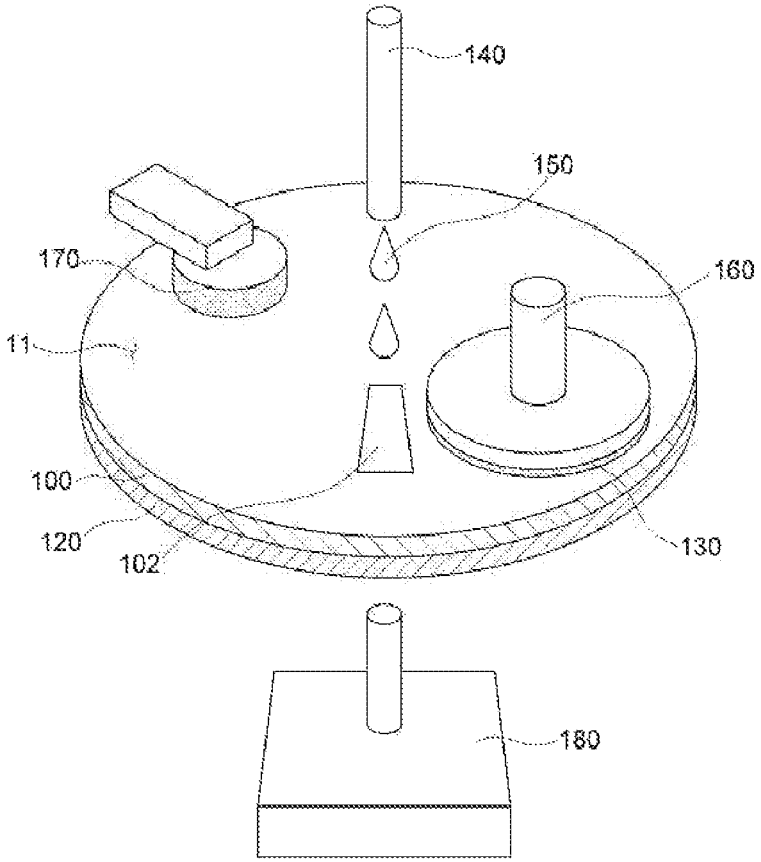

[FIG. 9(A)]
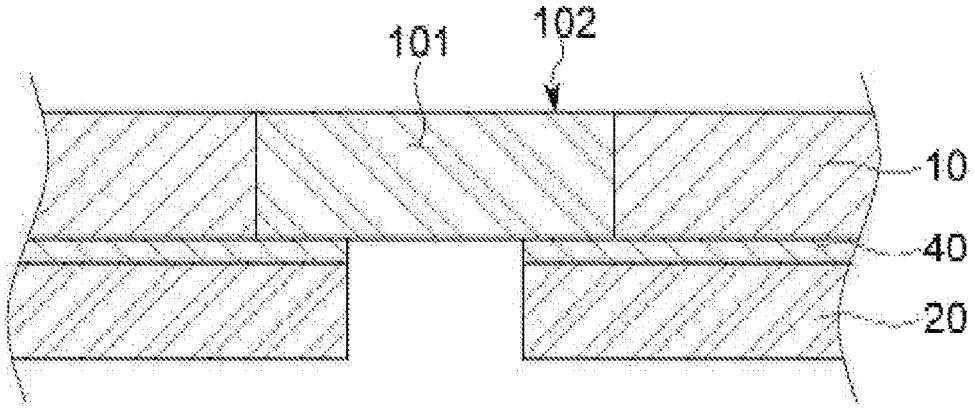
[FIG. 9(B)]
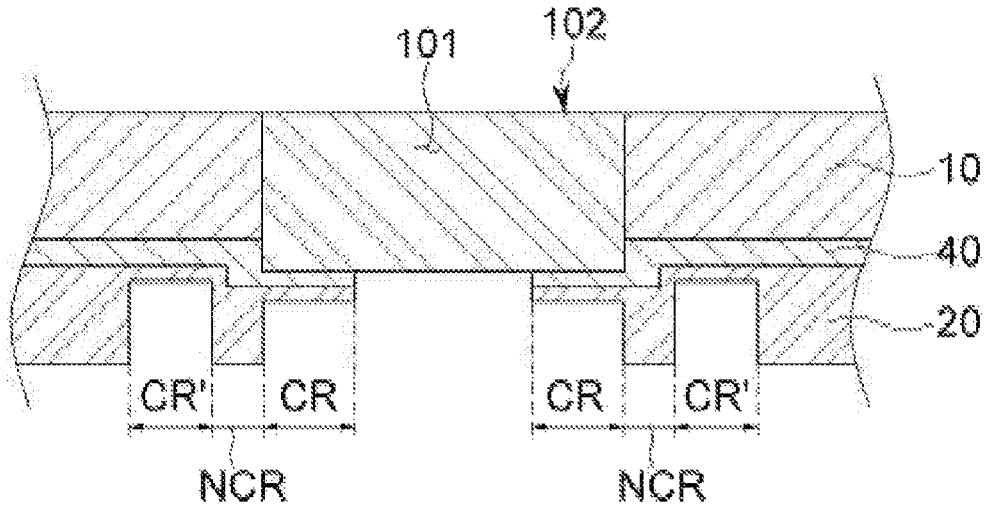

[FIG. 9(C)]
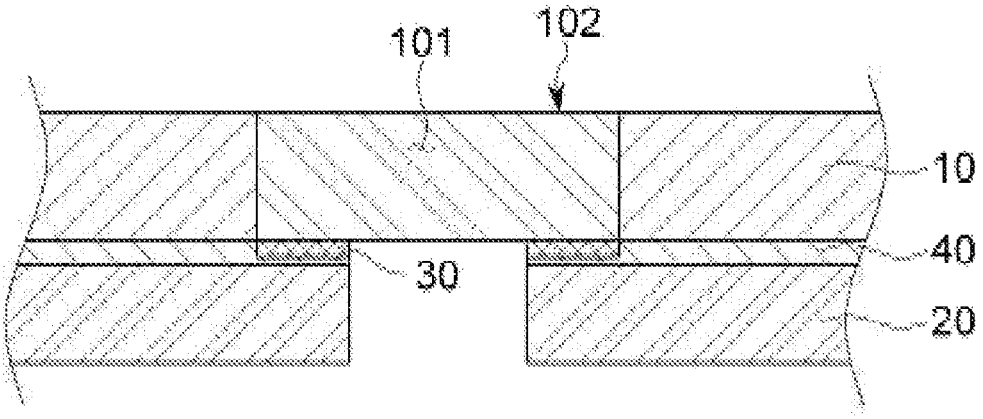
[FIG. 9(D)]
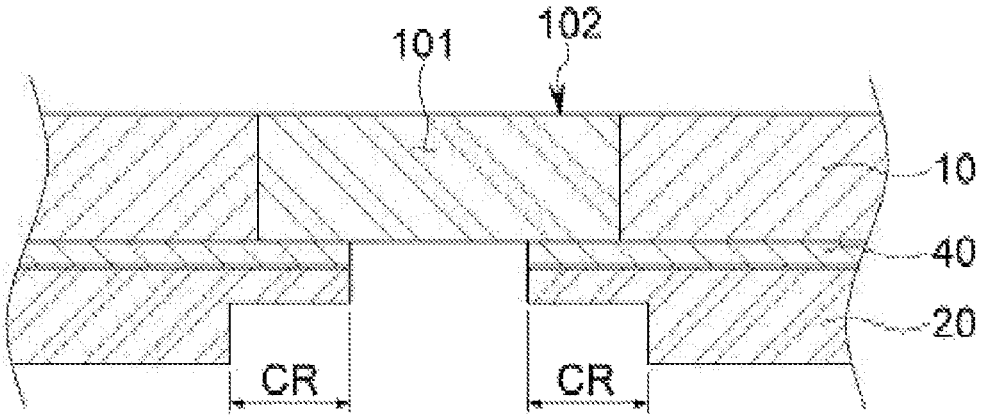

POLISHING PAD AND METHOD FOR MANUFACTURING SEMICONDUCTOR DEVICE USING THE SAME

CROSS-REFERENCE TO RELATED APPLICATIONS

This application claims priority to and the benefit of Korean Patent Application No. 10-2021-0087103 filed on Jul. 2, 2021, No, 10-2021-0134606 filed on Oct. 12, 2021, the disclosure of which is incorporated herein by reference in its entirety

TECHNICAL FIELD

The present invention relates to a polishing pad applied to a chemical and mechanical planarization process of a semiconductor substrate as a part of a semiconductor device manufacturing process, and a method for manufacturing a semiconductor device to which the polishing pad is applied.

BACKGROUND ART

A chemical mechanical planarization (CMP) or chemical mechanical polishing (CMP) process is used for various purposes in various fields. The CMP process is performed on a predetermined polishing surface to be polished, and may be performed for the purpose of planarizing the polishing surface, removing aggregated materials, eliminating crystal lattice damage, removing scratches and contamination sources, and the like.

CMP process technologies of semiconductor process may be classified according to the quality of a film to be polished or the surface shape after polishing. For example, the CMP process technologies may be divided into a CMP process for single silicon or a CMP process for polysilicon according to the quality of a film to be polished, and may be classified into CMP processes for various oxide films, which are distinguished by the types of impurities, or CMP processes for metal films such as tungsten (W), copper (W), aluminum (Al), ruthenium (Ru), and tantalum (Ta). In addition, according to the surface shape after polishing, the CMP process technologies may be classified into a process of reducing the roughness of the substrate surface, a process of planarizing a step generated by multilayer circuit wiring, and a device isolation process for selectively forming circuit wiring after polishing.

A plurality of CMP processes may be applied in a process for manufacturing a semiconductor device. A semiconductor device includes a plurality of layers, and each layer includes a complicated and fine circuit pattern. In addition, in recent semiconductor devices, the size of an individual chip has been reduced, and the pattern of each layer has become more complicated and finer. Accordingly, the CMP process in the process of manufacturing a semiconductor device has been expanded not only for the purpose of planarizing circuit wiring, but also for the application of isolation between circuit wirings and the improvement of the wiring surface, and the like, and as a result, more sophisticated and reliable CMP performance has been required.

A polishing pad which is used in this CMP process is a process part for processing a polishing surface to a required level through friction, and may be considered one of elements which are most important in the thickness uniformity of a polishing target after polishing, and the flatness and polishing quality of the polishing surface.

SUMMARY OF THE INVENTION

The present invention has been made in an effort to provide a polishing pad to which a window for detecting an end point is applied, in which the polishing pad minimizes a leak that is a pass of moisture permeability through an interface between the window and the polishing pad, and implements excellent long-term durability without leakage even though substantially applied to the polishing process for a long period of time.

The present invention has also been made in an effort to provide a method for manufacturing a semiconductor device to which the polishing pad is applied, in which a specific structure to which the window of the polishing pad is applied can be combined with the optimum process conditions related to the polishing process to further improve the process efficiency and an excellent quality is secured in terms of polishing rate, polishing flatness, prevention of defects, and the like.

An exemplary embodiment of the present invention provides a polishing pad including: a polishing layer including a first surface which is a polishing surface and a second surface which is an opposite surface thereof, and including a first through hole passing through the first surface and the second surface; a window disposed in the first through hole; and a support layer disposed at the second surface of the polishing layer, including a third surface and a fourth surface which is an opposite surface thereof at the polishing layer, and including a second through hole connected to the first through hole while passing through the third surface and the fourth surface, in which the second through hole is smaller than the first through hole, a lowermost surface of the window is supported by the third surface, a first adhesive layer is included between the lowermost surface of the window and the third surface, a second adhesive layer is included between the second surface and the third surface; and between the lowermost surface of the window and the third surface, and the support layer includes a compressed region in a region corresponding to the lowermost surface of the window.

The first adhesive layer may include a moisture curable resin, and the second adhesive layer may include a thermoplastic resin.

The first adhesive layer may not be disposed between a side surface of the first through hole and a side surface of the window.

The first adhesive layer may also be disposed between the side surface of the first through hole and the side surface of the window.

The support layer includes a non-compression region in a region other than the compressed region, and the percentage of the thickness of the compressed region may be 0.01% to 30% with respect to the thickness of the non-compression region.

The first surface includes at least one groove, and the groove may have a depth of 100 μm to 1500 μm and a width of 0.1 mm to 20 mm.

The first surface may include a plurality of grooves, the plurality of grooves may include concentric circular grooves, and the concentric circular grooves may have a spacing of 2 mm to 70 mm between two adjacent grooves.

The lowermost surface of the window may further include a recessed portion.

The recessed portion may have a depth of 0.1 mm to 2.5 mm.

The window may include a non-foamed-cured product of a window composition including a first urethane-based prepolymer, and the polishing layer may include a foamed-cured product of a polishing layer composition including a second urethane-based prepolymer.

A shore D hardness measured with respect to the first surface in a room temperature dry state may be smaller than a shore D hardness measured with respect to the uppermost surface of the window in a room temperature dry state.

Another exemplary embodiment provides a method for manufacturing a semiconductor device, the method including: providing a polishing pad provided with a polishing layer including a first surface which is a polishing surface and a second surface which is an opposite surface thereof, including a first through hole passing through the first surface and the second surface, and including a window disposed in the first through hole; and disposing a surface to be polished in a polishing target so as to be brought into contact with the first surface, and then polishing the polishing target while rotating the polishing pad and the polishing target relative to each other under pressurized conditions, in which the polishing target includes a semiconductor substrate, the polishing pad further includes a support layer disposed at the second surface of the polishing layer, the support layer includes a third surface and a fourth surface which is an opposite surface thereof at the polishing layer and includes a second through hole connected to the first through hole while passing through the third surface and the fourth surface, the second through hole is smaller than the first through hole, a lowermost surface of the window is supported by the third surface, a first adhesive layer is included between the lowermost surface of the window and the third surface, a second adhesive layer is included between the second surface and the third surface; and between the lowermost surface of the window and the third surface, and the support layer includes a compressed region in a region corresponding to the lowermost surface of the window.

The method for manufacturing a semiconductor device may further include supplying a polishing slurry on the first surface, in which the polishing slurry is sprayed on the first surface through a supply nozzle, and a flow rat of the polishing slurry sprayed through the supply nozzle may be 10 ml/min to 1,000 ml/min.

The polishing target and the polishing pad may have a rotation speed of 10 rpm to 500 rpm, respectively.

The polishing pad can minimize a leak through which a liquid component flows through an interface between the window and the polishing pad by a combination of a multi-stage adhesive layer structure and a compressed region structure, and can implement excellent long-term durability without leakage even though substantially applied to the polishing process for a long period of time.

In the method for manufacturing a semiconductor device, a specific structure to which the window of the polishing pad is applied can be combined with the optimum process conditions related to the polishing process to further improve the process efficiency and secure an excellent quality in terms of polishing rate, polishing flatness, prevention of defects, and the like.

BRIEF DESCRIPTION OF THE DRAWINGS

FIG. 1 is a plan view of a polishing pad according to an exemplary embodiment.

FIG. 2 schematically illustrates the cross-sectional view of a cross section cut by X-X' in the polishing pad according to an exemplary embodiment of FIG. 1.

FIG. 3 schematically illustrates the cross-sectional view of a polishing pad according to another exemplary embodiment.

FIG. 4 is a schematic view illustrating an enlarged view of the portion B of FIG. 2.

FIG. 5 is a schematic view illustrating an enlarged view of the portion A in FIG. 2.

FIG. 6 schematically illustrates a cross section of a polishing pad according to another exemplary embodiment.

FIG. 7 schematically illustrates a process of measuring the air leak of the polishing pad.

FIG. 8 is a schematic view schematically illustrating the method for manufacturing a semiconductor device according to an exemplary embodiment.

FIGS. 9 (A) to (D) schematically illustrate cross-sectional views of the polishing pads of Comparative Examples 1 to 4, respectively.

DETAILED DESCRIPTION

The benefits and features of the present invention, and the methods of achieving the benefits and features will become apparent with reference to Examples to be described below. However, the present invention is not limited to Examples to be disclosed below, but may be implemented in various other forms, and the present Examples are only provided for rendering the disclosure of the present invention complete and for fully representing the scope of the invention to a person with ordinary skill in the art to which the present invention pertains, and the present invention will be defined only by the scope of the claims.

In the drawings, in order to clearly express several layers and regions, their thicknesses are enlarged. Moreover, in the drawings, the thicknesses of some layers and regions are exaggerated for convenience of explanation. Throughout the specification, like reference numerals indicate like constituent elements.

In the present specification, a case where a part such as a layer, a film, a region, and a plate is present "above", "on" or "at an upper portion of" another part includes not only a case where the part is present "immediately on" another part, but also a case where still another part is present therebetween. Conversely, the case where a part is present "immediately on" another part means that no other part is present therebetween. Furthermore, a case where a part such as a layer, a film, a region, and a plate is present "under" or "at a lower portion of" another part includes not only a case where the part is present "immediately under" another part, but also a case where still another part is present therebetween. Conversely, the case where a part is present "immediately under" another part means that no other part is present therebetween.

In the present specification, modifiers such as "first" or "second" are for distinguishing cases where their superordinate configurations are different, and such modifiers alone do not mean that the mutual configurations are specifically different types.

Hereinafter, exemplary embodiments according to the present invention will be described in detail.

In an exemplary embodiment of the present invention, provided is a polishing pad including: a polishing layer including a first surface which is a polishing surface and a second surface which is an opposite surface thereof, and including a first through hole passing through the first surface and the second surface; a window disposed in the first through hole; and a support layer disposed at the second surface of the polishing layer, including a third surface and a fourth surface which is an opposite surface thereof at the polishing layer, and including a second through hole connected to the first through hole while passing through the third surface and the fourth surface, in which the second through hole is smaller than the first through hole, a lowermost surface of the window is supported by the third surface, a first adhesive layer is included between the lowermost surface of the window and the third surface, a second adhesive layer is included between the second surface and the third surface; and between the lowermost surface of the window and the third surface, and the support layer includes a compressed region in a region corresponding to the lowermost surface of the window.

The polishing pad is one of the essential raw and auxiliary materials for the polishing process that requires the planarization of the surface and the like, and is one of the important process parts particularly in the process of manufacturing a semiconductor device. The purpose of the polishing pad is to planarize a non-flat structure and to facilitate a subsequent processing such as removing surface defects. The polishing process is a process that is applied to other technical fields in addition to the semiconductor technology field, but it can be said that the precision of the polishing process required in the semiconductor manufacturing process is at the highest level compared to other technical fields. Considering the recent tendency of high integration and ultra-miniaturization of a semiconductor device, the overall quality of the semiconductor device significantly deteriorates even with very small errors in the polishing process during the manufacturing process of the semiconductor device. Therefore, a polishing end point detection technology has been introduced such that when a semiconductor substrate is polished to an exactly desired degree for fine control of the polishing process, the polishing can be stopped.

FIG. 1 schematically illustrates a plan view of a polishing pad 100 according to an exemplary embodiment. Referring to FIG. 1, the polishing pad 100 may include a window 102. Specifically, although the polishing pad 100 has non-light transmission as a whole, the end point of polishing may be determined by introducing a window 102 having local light transmission to sense a change in film quality by an optical signal such as a laser. The window 102 for detecting such an end point is a part made of a material and physical properties different from the basic material and physical properties constituting the polishing layer of the polishing pad 100, and as the window is introduced, a portion having a locally different texture is generated on the polishing surface of the polishing layer. Since the polishing of the semiconductor substrate utilizes the polishing surface of the polishing pad including the uppermost surface of the window as a whole, it can be said that it is an important factor in determining the quality of the semiconductor device to minimize the negative influence of the local heterogeneity of a portion where the window is introduced on the polishing of the semiconductor substrate.

From this point of view, the polishing pad 100 according to an exemplary embodiment may function as a process part capable of manufacturing an excellent semiconductor device by applying a specific structural feature in introducing the window to secure the process advantage by the window 102, and simultaneously minimizing the negative element due to the local heterogeneity of a portion where the window 102 is introduced.

FIG. 2 schematically illustrates the cross-sectional view of the polishing pad 100 according to an exemplary embodiment, and specifically, FIG. 2 schematically illustrates the X-X' cut surface of FIG. 1. Referring to FIG. 2, the polishing pad 100 includes a polishing layer 10, and the polishing layer 10 includes a first surface 11 which is a polishing surface and a second surface 12 which is an opposite surface thereof. Further, the polishing layer 10 includes a first through hole 101 passing through the first surface 11 and the second surface 12, and the window 102 is disposed in the first through hole 101.

The polishing pad 100 further includes a support layer 20 disposed at the second surface 12 of the polishing layer 10. The support layer 20 includes a third surface 21 and a fourth surface 22 which is an opposite surface thereof at the polishing layer 10, and includes a second through hole 201 connected to the first through hole 101 while passing through the third surface 21 and the fourth surface 22. By forming the second through hole 201 so as to be connected to the first through hole 101, the polishing pad 100 includes a light-pass which passes through the entire thickness from the uppermost surface to the lowermost surface, and an optical end point detection method through the window 102 may be efficiently applied.

In the polishing pad 100, the second through hole 102 is smaller than the first through hole 101, and the lowermost surface of the window 101 may be supported by the third surface 21. By forming the second through hole 102 smaller than the first through hole 101, a support surface capable of supporting the window 101 may be formed on the third surface 21. In this case, a first adhesive layer 30 is included between the lowermost surface of the window and the third surface 21. Furthermore, a second adhesive layer 40 is included between the second surface 12 and the third surface 21; and between the lowermost surface of the window and the third surface 21. As a result, a multi-stage adhesive layer including the first adhesive layer 30 and the second adhesive layer 40 is included between the lowermost surface of the window and the third surface 21, and a leakage prevention effect may be significantly improved through such a multi-stage adhesive structure. Specifically, the polishing process to which the polishing pad 100 is applied is performed while supplying a fluid such as a liquid slurry onto the polishing surface 11, and in this case, components derived from such a fluid may flow into the interface between the side surface of the window 102 and the side surface of the first through hole 101. When the fluid component thus permeated passes through the second through hole 201 and flows into a polishing device at the lower stage of the polishing pad 100, there is a concern of causing the polishing device to fail or interfering with the accurate end point detection of the window 102. From this point of view, the polishing pad 100 may significantly improve a leakage prevention effect by forming the second through hole 201 to be smaller than the first through hole 101 to secure a support surface of the window 102 on the third surface 21, and simultaneously forming a multi-stage adhesive layer including the first adhesive layer 30 and the second adhesive layer 40 on the support surface.

The polishing pad 100 partially includes a compressed region (CR) in the support layer 20 in order to maximize the leakage prevention effect. Specifically, referring to FIG. 2, the compressed region (CR) is formed in a region corresponding to the lowermost surface of the window 102 of the support layer 20. In this case, the region corresponding to the lowermost surface of the window 102 means a predetermined region including a portion corresponding to the lowermost surface of the window 102 in the support layer 20, and an extended line of the side surface of the window 102 and the inner end of the compressed region (CR) do not necessarily have to coincide. That is, the compressed region (CR) suffices to be formed on a predetermined region so as to include all the portions corresponding to the lowermost surface of the window 102 from the side surface of the second through hole 201 toward the inside of the support layer 20.

In an exemplary embodiment, the compressed region (CR) may have a continuous structure so as to include all the portions corresponding to the lowermost surface of the window 102 from the side surface of the second through hole 210 toward the inside of the support layer. In another aspect, the compressed region (CR) is a continuous compressed region including all the portions corresponding to the lowermost surface of the window 102, and may not include two or more portions partitioned by a non-compression region (NCR) in the compressed region. When described from still another aspect, the compressed region (CR) may be a continuous compressed region integrally formed so as to include all the portions corresponding to the lowermost surface of the window 102. That is, the compressed region (CR) is a continuous compressed region integrally formed by being pressurized at the fourth surface 22 which is the lower surface of the support layer 20, and does not include two or more compressed regions having different pressurizing directions in the forming process. Through this, not only the process efficiency may be maximized, but also the high-density region formed by the pressurizing process may be more advantageous in improving the leakage prevention effect.

As described above, by forming a compressed region (CR) in a region corresponding to the lowermost surface of the window 102 of the support layer 20, the compressed region (CR) may constitute a high-density region compared to a non-compression region (NCR), and may serve to effectively prevent a fluid component capable of flowing into the interface between the side surface of the window 102 and the side surface of the first through hole 101 together with the multi-stage adhesive layer through this. As a result, the polishing pad 100 according to an exemplary embodiment may implement a leakage prevention effect remarkably improved compared to the related art because a multi-stage adhesive layer structure between the lowermost surface of the window 102 and the third surface 21 is organically combined with the compressed region (CR) structure of the support layer (20).

In an exemplary embodiment, the first adhesive layer 30 may include a moisture curable resin, and the second adhesive layer 40 may include a thermoplastic resin. In an exemplary embodiment, the first adhesive layer 30 and the second adhesive layer 40 may be sequentially disposed in a direction from the lowermost surface of the window 102 toward the third surface 21. The first adhesive layer 30 is an adhesive layer where a leaked fluid component primarily contacts between the side surface of the window 102 and the side surface of the first through hole 101, and the first adhesive layer 30 may include a moisture curable resin to significantly improve the leakage prevention effect. The second adhesive layer 40 is a configuration of a multi-stage adhesive layer between the lowermost surface of the window 102 and the third surface 21, and simultaneously a layer disposed between the second surface 12 and the third surface 21 in order to attach the polishing layer 10 and the support layer 20, and since the second adhesive layer 40 includes a thermoplastic resin, and thus is laminated with the first adhesive layer 30, it is possible to improve the leakage prevention effect and simultaneously secure the excellent interfacial durability of the polishing layer 10 and the support layer 20

The first adhesive layer 30 may include a moisture-cured product of a moisture curable adhesive composition including a urethane-based prepolymer polymerized and formed from a monomer component including an aromatic diisocyanate; and a polyol. Here, 'moisture curability' means a property that moisture serves as a curing initiator, and the moisture curable adhesive composition is an adhesive composition in which moisture in the air serves as a curing initiator. In the present specification, the 'prepolymer' means a polymer having a relatively low molecular weight, in which the degree of polymerization is discontinued in an intermediate step so as to facilitate molding in the preparation of a cured product. The prepolymer is subjected to additional curing steps such as heating and/or pressurization as it is, or is mixed with other polymerizable compounds, for example, additional compounds such as heterogeneous monomers or heterogeneous prepolymers, and reacted with each other, and then may be molded as a final cured product.

The first adhesive layer 30 is derived from a moisture curable adhesive composition including a urethane-based prepolymer polymerized and formed from the monomer component, whereby the leakage prevention effect may be significantly improved based on the excellent compatibility of the first adhesive layer 30 and the second adhesive layer 40 while significantly improving the interfacial adhesion between the window 102 and the first adhesive layer 30.

More specifically, the first adhesive layer 30 may include a moisture-cured product of a moisture curable adhesive composition including: a urethane-based prepolymer polymerized and formed from a monomer component including: an aromatic diisocyanate of the following Chemical Formula 1; and a diol having 2 to 10 carbon atoms; and an unreacted aromatic diisocyanate of the following Chemical Formula 1.

[Chemical Formula 1]

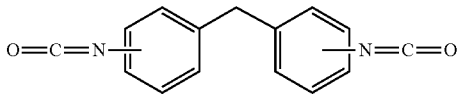

For example, the monomer component may include a diol having 2 to 10 carbon atoms, for example, 3 to 10 carbon atoms, for example, 4 to 10 carbon atoms, and for example, 5 to 10 carbon atoms.

More specifically, the first adhesive layer 30 may include a moisture-cured product of a moisture curable adhesive composition including: a urethane-based prepolymer polymerized and formed from a monomer component including: the aromatic diisocyanate of Chemical Formula 1; a diol of the following Chemical Formula 2; and a diol of the following Chemical Formula 3; and the unreacted aromatic diisocyanate of Chemical Formula 1.

[Chemical Formula 2]

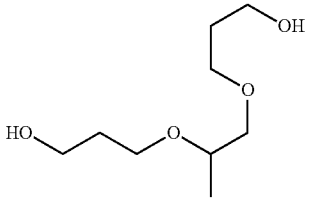

-continued

[Chemical Formula 3]

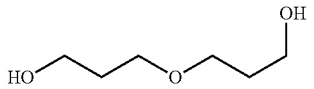

The adhesive composition may include the urethane-based prepolymer and the unreacted aromatic diisocyanate in an amount of about 90 wt % to about 99 wt % and about 1 wt % to about 10 wt %, respectively. For example, the adhesive composition may include the urethane-based prepolymer in an amount of about 91 wt % to about 99 wt %, for example, about 93 wt % to about 99 wt %, and for example, about 95 wt % to about 99 wt %, and may include the unreacted aromatic diisocyanate in an amount of about 1 wt % to about 9 wt %, for example, about 1 wt % to about 7 wt %, and for example, about 1 wt % to about 5 wt %. The unreacted aromatic diisocyanate means a diisocyanate that is present in a state where the isocyanate groups (—NCO) at both ends do not react with urethane.

In an exemplary embodiment, the moisture-cured product of the moisture curable adhesive composition may be a product resulting from pressurization and ultrasonic fusion; pressurization and thermal fusion; or pressurization, ultrasonic fusion, and thermal fusion of the moisture curable adhesive composition.

The adhesive composition for the first adhesive layer 30 may have a viscosity of about 5,000 mPa·s to about 10,000 mPa·s, for example, about 6,000 mPa·s to about 9,000 mPa·s, at room temperature. Here, the room temperature means a temperature in a range of about 20° C. to about 30° C. When the viscosity of the adhesive composition satisfies such a range, excellent process efficiency may be secured in the process of forming the first adhesive layer 30, and simultaneously, the density of the first adhesive layer 30 formed by curing the adhesive composition may be more advantageous in the leakage prevention effect.

Specifically, the second adhesive layer 40 may include one selected from the group consisting of a thermoplastic urethane-based adhesive, a thermoplastic acrylic adhesive, a thermoplastic silicon-based adhesive, and combinations thereof. The second adhesive layer 40 may include a thermoplastic resin, thereby obtaining a technical advantage in terms of improving process efficiency compared to the case where the second adhesive layer 40 includes a thermosetting resin. Specifically, when a thermosetting adhesive is used as the second adhesive layer 40, the efficiency of mass production deteriorates because it is difficult to apply a roll-to-roll process, and there is a concern in that the degree of pad contamination caused by scattering may be increased because a spray application method and the like need to be applied instead of roll-to-roll. That is, the second adhesive layer 40 is a layer formed in a large area between the second surface and the third surface, and may be more advantageous in securing excellent compatibility in terms of increasing the process efficiency by applying a thermoplastic adhesive, remarkably reducing the defect rate by preventing the contamination of the polishing pad, and securing the first adhesive layer 40 derived from the moisture curable adhesive and the leakage prevention effect.

In an exemplary embodiment, the second adhesive layer 40 may have a thickness of about 15 μm to about 40 μm, for example, about 15 μm to about 35 μm, for example, about 20 μm to about 35 μm, and for example, about 22 μm to about 32 μm. When the thickness of the second adhesive layer 40 satisfies the above range, it may be more advantageous in securing sufficient adhesion between the second surface 12 and the third surface 21, and simultaneously, contributing to the leakage prevention effect as a configuration of the multi-stage adhesive layer on the lowermost surface of the window 102.

Referring to FIG. 2, in the polishing pad 100 according to an exemplary embodiment, the first adhesive layer 30 may not be disposed between the side surface of the window 102 and the side surface of the first through hole 101. In still another aspect, the first adhesive layer 30 may be brought into contact with the window 102 only through the lowermost surface of the window 102. That is, the first adhesive layer 20 disposed between the side surface of the window 102 and the side surface of the first through hole 101 may have a length of 0 μm. Through such a structure, a gap between the side surface of the window 102 and the side surface of the first through hole 101 may be minimized, and as a result, it is possible to obtain a technical advantage in terms of preventing the introduction of a liquid component itself or preventing process debris and the like from accumulating in the gap.

FIG. 3 schematically illustrates a cross-sectional view of the polishing pad 100' according to another exemplary embodiment. Referring to FIG. 3, the first adhesive layer 30 may also be disposed between the side surface of the window 102 and the side surface of the first through hole 101. In yet another aspect, the first adhesive layer 30 may be brought into contact with the window 102 through the lowermost surface of the window 102; and the side surface of the window 102. The first adhesive layer 30 disposed between the side surface of the window 102 and the side surface of the first through hole 101 may have a length (L1) of, for example, about 0.1 μm to about 20 μm, for example, about 0.1 μm to about 10 μm, and for example, about 0.1 μm to about 5 μm. Through such a structure, it is possible to obtain a technical advantage in terms of minimizing a pass through which a liquid component can move from the uppermost surface of the window and the polishing surface and preventing the loading of debris.

Referring to FIG. 2 or 3, the width (W3) of the first adhesive layer 30 disposed on the lowermost surface of the window 102 may be the same as or longer than the width (W2) of a portion supported by the third surface 21 in the lowermost surface of the window 102. Through such a structure, the end of the interface between the side surface of the window 102 and the side surface of the first through hole 101 may be effectively sealed by the first adhesive layer 30, and it may be more advantageous in terms of improving the leakage prevention effect.

The first adhesive layer 30 disposed on the lowermost surface of the window 102 may have a width (W3) of about 2 mm to about 15 mm, for example, about 2 mm to about 12 mm, for example, about 2 mm to about 10 mm, for example, about 2.5 mm to about 9.5 mm, and for example, about 3.5 mm to about 9.5 mm. When the width (W3) of the first adhesive layer 30 satisfies the above range and the correlation with the width (W2) of a portion supported by the third surface 21 in the lowermost surface of the window 102 satisfy those described above, efficiency may be enhanced in terms of securing the structural durability supported by the support layer while securing a light transmission region of the window as wide as possible. Further, it may be advantageous in terms of securing a pass long enough to block the liquid component that may leak through the interface between the side surface of the window 102 and the side surface of the first through hole 101.

Referring to FIG. 2, as described above, the support layer 20 includes a compressed region (CR) in a region corresponding to the lowermost surface of the window 102, and simultaneously, may include a non-compression region (NCR) in a region excluding the compressed region (CR). The non-compression region (NCR) has a predetermined porosity, and has a buffering action such that an external force applied to the polishing pad 100 is not transmitted to the polishing target through the polishing surface 11, and may serve to support the polishing layer 10.

Referring to FIG. 2, the percentage of the thickness (H2) of the compressed region (CR) may be about 0.01% to about 80%, for example, about 0.01% to about 60%, for example, about 0.01% to about 50%, for example, about 0.1% to about 50%, for example, about 1% to about 50%, for example, about 1% to about 45%, for example, about 2% to about 45%, for example, about 5% to about 45%, for example, about 10% to about 45%, for example, about 15% to about 45%, and for example, about 20% to about 45%, compared to the thickness (H1) of the non-compression region (NCR). That is, the value of H2/H1*100 may satisfy the above range. By compressing the compressed region (CR) so as to have a thickness that satisfies the percentage in the above range compared to the thickness of the non-compression portion (NCR), it may be more advantageous in improving the leakage prevention effect together with the multi-stage adhesive layer structure of the lowermost surface of the window 102. Further, the compressed region (CR) may constitute a high-density region effective in preventing leakage while interfering with the buffering function and the supporting function of the non-compression region (NCR).

Referring to FIG. 2, the percentage of the thickness (H2) of the compressed region (CR) may be about 0.01% to about 30%, for example, about 0.01% to about 20%, for example, about 0.1% to about 20%, for example, about 1% to about 20%, for example, about 1% to about 15%, for example, about 2% to about 15%, for example, about 2% to about 10%, and for example, about 3% to about 9%, compared to the width of the compressed region (CR). When the thickness of the compressed region (CR) satisfies the ratio described compared to the width, it may be advantageous in implementing the optimal leakage prevention effect while the compressed region (CR) region does not interfere with the overall support capacity of the support layer 20.

FIG. 4 is a schematic view illustrating an enlarged view of the portion B of FIG. 2. Referring to FIG. 4, the height of the uppermost surface 102 of the window may be lower than that of the first surface 11. Specifically, the difference (d3) in height between the uppermost surface 102 of the window and the first surface 11 may be about 0 μm to about 300 μm, for example, about 0 μm to about 250 μm, for example, about 50 μm to about 250 μm, and for example, about 50 μm to about 150 μm. When the difference in height between the uppermost surface 102 of the window and the first surface 11 has the correlation as described above, it may be advantageous in terms of minimizing the possibility of the liquid component leaking to the interface between the side surface of the window 102 and the side surface of the first through hole 101. More specifically, when the surface hardness of the uppermost surface 102 of the window and the first surface 11 satisfies the relationship to be described below, and simultaneously, the difference in height between the uppermost surface of the window 102 and the first surface 11 satisfies those as described above, it may be more advantageous because the polishing interface may move smoothly during the polishing over the uppermost surface of the window 102 and the first surface 11, and through this, it may be more advantageous in maximizing the leakage prevention effect.

FIG. 5 is a schematic view illustrating an enlarged view of the portion A in FIG. 2. Referring to FIG. 5, the first surface 11 may include at least one groove 111. The groove 111 has a groove structure processed to a depth (d1) smaller than the thickness (D1) of the polishing layer 10, and may perform a function of securing the fluidity of a liquid component such as a polishing slurry and a cleaning liquid applied onto the first surface 11 during the polishing process. The fluidity of the polishing slurry or the like applied to the first surface 11 is closely associated with leakage through the interface between the side surface of the window 102 and the side surface of the first through hole 101, and may contribute to maximizing the leakage prevention effect of the polishing pad 100 through the appropriate structural design of the groove 111.

In an exemplary embodiment, the planar structure of the polishing pad 100 may be substantially circular, and the at least one groove 111 may have a concentric circular structure disposed to be separated from the center toward the end of the polishing layer 10 on the first surface 11 at predetermined intervals. In another exemplary embodiment, the at least one groove 111 may have a radial structure continuously formed from the center toward the end of the polishing layer 10 on the first surface 11. In still another exemplary embodiment, the at least one groove 111 may simultaneously include a concentric circular structure and a radial structure.

In an exemplary embodiment, the polishing layer may have a thickness (D1) of about 0.8 mm to about 5.0 mm, for example, about 1.0 mm to about 4.0 mm, for example, about 1.0 mm to 3.0 mm, for example, about 1.5 mm to about 3.0 mm, for example, about 1.7 mm to about 2.7 mm, and for example, about 2.0 mm to about 3.5 mm.

In an exemplary embodiment, the groove 111 may have a width (w1) of about 0.1 mm to about 20 mm, for example, about 0.1 mm to about 15 mm, for example, about 0.1 mm to about 10 mm, for example, about 0.1 mm to about 5 mm, and for example, about 0.1 mm to about 1.5 mm.

In an exemplary embodiment, the groove 111 may have a depth (d1) of about 100 μm to about 1500 μm, for example, about 200 μm to about 1400 μm, for example, about 300 μm to about 1300 μm, for example, about 400 μm to about 1200 μm, for example, about 400 μm to about 1000 μm, and for example, about 400 μm to about 800 μm.

In an exemplary embodiment, when the first surface 11 includes a plurality of grooves 111 and the plurality of grooves 111 include concentric circular grooves, a pitch (p1) between two adjacent grooves (111) of the concentric circular groove may be about 2 mm to about 70 mm, for example, about 2 mm to about 60 mm, for example, about 2 mm to about 50 mm, for example, about 2 mm to about 35 mm, for example, about 2 mm to about 10 mm, and for example, about 2 mm to about 8 mm.

When the at least one groove 111 satisfies each or all of the depth (d1), width (w1) and pitch (p1) in the above-described ranges, the fluidity of the polishing slurry implemented through this may be appropriately secured so as to maximize the leakage prevention effect through the interface between the side surface of the window 102 and the side surface of the first through hole 101. In yet another aspect, when the depth (d1), width (w1) and pitch (p1) of the at least one groove 111 are beyond the above-described ranges, and thus, the fluidity of the resulting polishing slurry is excessively fast or the flow rate per unit time is excessively high, there is a concern in that the polishing slurry component fails to perform its original function and may be discharged to the outside of the first surface 11, and conversely, when the fluidity of the polishing slurry is excessively slow or the flow rate per unit time is excessively low, the slurry component that needs to perform the physical and chemical polishing function on the polishing surface fail to perform its original function and the amount of polishing slurry leaking through the interface between the side surface of the window 102 and the side surface of the first through hole 101 is rapidly increased, so that there is a concern in that the long-term durability of the leakage prevention effect through the multi-stage adhesive structure of the first adhesive layer 30 and the second adhesive layer 4 and the compressed region of the support layer may deteriorate. That is, when the at least one groove 111 satisfies each or all of the depth (d1), width (w1) and pitch (p1) in the above-described ranges, it may be advantageous in maximizing the leakage prevention effect through the multi-stage adhesive structure and the compressed region.

Referring to FIG. 5, the polishing layer 10 may have a porous structure including a plurality of pores 112. The plurality of pores 112 are dispersed throughout the polishing layer 10, and the polishing surface 11 may serve to continuously create a predetermined roughness on the surface even during the process of being ground by a conditioner or the like during the polishing process. A part of the plurality of pores 112 may be exposed to the outside on the first surface 11 of the polishing layer 10 and thus may appear as a fine concave portion 113 distinguished from the groove 111. The fine concave portion 113 may perform a function of determining the fluidity and mooring space of a polishing liquid or a polishing slurry together with the groove 112 during the use of the polishing pad 100, and may perform a function of physically providing a frictional force for polishing a surface to be polished.

The plurality of pores 112 may have an average pore size of about 10 μm to about 30 μm, for example, about 10 μm to about 25 μm, for example, about 15 μm to about 25 μm, and for example, about 18 μm to about 23 μm. For the size of the average pores, a cross section was observed from an image of a 1 $mm^2$ polishing surface obtained by cutting the polishing pad into a 1 mm×1 mm square (thickness: 2 mm) and magnifying the cut polishing pad 100 times using a scanning electron microscope (SEM), and then the diameters of the entire pores were measured from an image obtained using an image analysis software, and the number of pores was obtained. The average pore size was derived as a number average value obtained by dividing the sum of the diameters of a plurality of pores in 1 $mm^2$ of the polishing surface by the number of the plurality of pores. The polishing layer 10 may have appropriate mechanical properties by having a porous structure composed of a plurality of pores satisfying the average pore size, and such mechanical properties show the mechanical and physical properties of the window 102 and excellent compatibility, so that it may be more advantageous in terms of preventing leakage by minimizing a leak in which a liquid component leaks between the polishing layer 10 and the window 102.

The first surface 11 may have a predetermined surface roughness by the fine concave portion 113. In an exemplary embodiment, the first surface 11 may have a surface roughness (Ra) of about 1 μm to about 20 μm, for example, about 2 μm to about 18 μm, for example, about 3 μm to about 16 μm, for example, about 4 μm to about 14 μm, and for example, about 4 μm to about 10 μm. When the surface roughness (Ra) of the first surface 11 satisfies the above range, it may be advantageous in appropriately securing the fluidity of the polishing slurry by the fine recessed portion 113 in regard to the leakage prevention effect of the multi-stage adhesive structure and the compressed region.

FIG. 6 schematically illustrates the cross section of the polishing pad 200 according to still another exemplary embodiment. Referring to FIG. 6, the polishing pad 200 may further include a recessed portion 103 on the lowermost surface of the window 102. The recessed portion 103 is a concave portion processed so as to have a predetermined depth d2 in a direction from the lowermost surface to the uppermost surface of the window 102, and may enable more accurate end point detection by shortening the transmission pass of light passing through the window 102 for end point detection.

The recessed portion 103 may have a depth (d2) smaller than the thickness (D2) of the window 102. The window 102 may have a thickness (D2) of about 1.5 mm to about 3.0 mm, for example, about 1.5 mm to about 2.5 mm, and for example, about 2.0 mm to 2.2 mm. The recessed portion 103 may have a depth (d2) of, for example, about 0.1 mm to about 2.5 mm, for example, about 0.1 mm to about 2.0 mm, for example, about 0.1 mm to about 1.5 mm, and for example, about 0.6 mm to about 1.0 mm. When the thickness (D2) of the window 102 and the depth (d2) of the recessed portion 103 satisfy the above ranges, respectively or simultaneously, an excellent end point detection function may be implemented. Further, at the same time, as the length of a pass where leakage may occur appears as a pass having the same length as the depth of the window (102), an effective structure may be secured even in terms of preventing the leakage.

In an exemplary embodiment, a shore D hardness measured with respect to the first surface 11 in a room temperature dry state may be smaller than a shore D hardness measured with respect to the uppermost surface of the window 102 in a room temperature dry state. Here, the room temperature dry state means a dry state in which the wet conditions to be described below are not processed under a temperature condition within a range of about 20° C. to about 30° C. For example, the difference between the shore D hardness measured with respect to the first surface 11 in a room temperature dry state and the shore D hardness measured with respect to the uppermost surface of the window 102 in a room temperature dry state may be about 5 to about 10, for example, about 5 to about 7, and for example, about 5.5 to about 6.5.

In an exemplary embodiment, a Shore D hardness measured with respect to the uppermost surface of the window 102 in a room temperature dry state may be about 60 to about 70, for example, about 60 to 68, and for example, about 60 to about 65. In an exemplary embodiment, a Shore D hardness measured with respect to the first surface 11 in a room temperature dry state may be about 50 to about 65, for example, about 53 to 65.

In an exemplary embodiment, the difference between the Shore D wet hardness measured with respect to the uppermost surface of the window 102 at 30° C. and the Shore D wet hardness measured with respect to the uppermost surface of the window 102 in a room temperature dry state may be about 0 to about 1.0, for example, about 0 to about 0.8.

In an exemplary embodiment, a shore D wet hardness measured with respect to the uppermost surface of the window 102 at 50° C. may be smaller than a shore D wet hardness measured with respect to the uppermost surface of the window 102 in a room temperature dry state. For example, the difference between the shore D wet hardness measured with respect to the uppermost surface of the window 102 at 50° C. and the shore D wet hardness measured with respect to the uppermost surface of the window 102 in a room temperature dry state may be about 1 to about 7, for example, about 1 to about 6, and for example, about 1 to 5.5.

In an exemplary embodiment, a shore D wet hardness measured with respect to the uppermost surface of the window 102 at 70° C. may be smaller than a shore D wet hardness measured with respect to the uppermost surface of the window 102 in a room temperature dry state. For example, the difference between the Shore D wet hardness measured with respect to the uppermost surface of the window 102 at 70° C. and the Shore D wet hardness measured with respect to the uppermost surface of the window 102 in a room temperature dry state may be about 5 to about 10, for example, about 6 to about 10, and for example, about 7 to 10.

In an exemplary embodiment, a shore D wet hardness measured with respect to the first surface 11 of the polishing layer 10 at 30° C. may be smaller than a shore D wet hardness measured with respect to the uppermost surface of the window 30 at 30° C. For example, the difference in Shore D wet hardness measured at 30° C. between the first surface 11 of the polishing layer and the uppermost surface of the window 30 may be more than about 0 and about 15 or less, for example, about 1 to about 15, and for example, about 2 to about 15.

In an exemplary embodiment, a shore D wet hardness measured with respect to the first surface 11 of the polishing layer at 50° C. may be smaller than a shore D wet hardness measured with respect to the uppermost surface of the window 30 at 50° C. For example, the difference in Shore D wet hardness measured at 50° C. between the first surface 11 of the polishing layer and the uppermost surface of the window 30 may be more than about 0 and about 15 or less, for example, about 1 to about 25, for example, about 5 to about 25, and for example, about 5 to about 15.

In an exemplary embodiment, a shore D wet hardness measured with respect to the first surface 11 of the polishing layer at 70° C. may be smaller than a shore D wet hardness measured with respect to the uppermost surface of the window 30 at 70° C. For example, the difference in Shore D wet hardness measured at 70° C. between the first surface 11 of the polishing layer and the uppermost surface of the window 30 may be more than about 0 and about 15 or less, for example, about 1 to about 25, for example, about 5 to about 25, and for example, about 8 to about 16.

Here, the Shore D wet hardness is a surface hardness value measured after the window 30 or the polishing layer 10 is immersed in water at a corresponding temperature for 30 minutes.

The polishing process to which the polishing pad 100 is applied is mainly a process of polishing while applying a liquid slurry onto the first surface 11. In addition, the temperature of the polishing process may be changed mainly in a range of about 30° C. to about 70° C. That is, when the hardness change of the uppermost surface of the window 102 derived based on the Shore D hardness measured under the temperature condition and wet environment similar to an actual process satisfies the above-described tendency, and simultaneously, the hardness relationship between the first surface 11 and the uppermost cross section of the window 102 in a room temperature dry state satisfies the above-described range, the polishing operation is smoothly performed during the polishing over the uppermost surface of the window 102 and the first surface 11, so that it may be advantageous in minimizing the possibility of leakage of the liquid component at the interface between the side surface of the first through hole 101 and the side surface of the window 102.

In an exemplary embodiment, the window 102 may include a non-foamed-cured product of a window composition including a first urethane-based prepolymer. When the window 102 includes a non-foamed-cured product, it may be more advantageous in securing a light transmittance and a suitable surface hardness required for end point detection compared to the case where the foamed-cured product is included. The 'prepolymer' means a polymer having a relatively low molecular weight, in which the degree of polymerization is discontinued in an intermediate step so as to facilitate molding in the preparation of a cured product. The prepolymer is subjected to additional curing steps such as heating and/or pressurization as it is, or is mixed with other polymerizable compounds, for example, additional compounds such as heterogeneous monomers or heterogeneous prepolymers, and reacted with each other, and then may be molded as final cured product.

The first urethane-based prepolymer may be prepared by reacting a first isocyanate compound with a first polyol compound. The first isocyanate compound may include one selected from the group consisting of an aromatic diisocyanate, an aliphatic diisocyanate, an alicyclic diisocyanate and combinations thereof. In an exemplary embodiment, the first isocyanate compound may include an aromatic diisocyanate and an alicyclic diisocyanate.

The first isocyanate compound may include one selected from the group consisting of, for example, 2,4-toluene diisocyanate (2,4-TDI), 2,6-toluene diisocyanate (2,6-TDI), naphthalene-1,5-diisocyanate, p-phenylene diisocyanate, tolidine diisocyanate, 4,4'-diphenylmethane diisocyanate, hexamethylene diisocyanate, dicyclohexylmethane diisocyanate, 4,4'-dicyclohexylmethane diisocyanate ($H_{12}MDI$), isoporone diisocyanate and combinations thereof.

The first polyol compound may include one selected from the group consisting of, for example, a polyether-based polyol (polyether polyol), a polyester-based polyol (polyester polyol), a polycarbonate-based polyol (polycarbonate polyol), an acrylic polyol (acryl polyol) and combinations thereof. The 'polyol' means a compound including at least two hydroxyl groups (—OH) per molecule. In an exemplary embodiment, the first polyol compound may include a dihydric alcohol compound having two hydroxyl groups, that is, diol or glycol. In an exemplary embodiment, the first polyol compound may include a polyether-based polyol.

The first polyol compound may include one selected from the group consisting of, for example, polytetramethylene ether glycol (PTMG), polypropylene ether glycol, ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol (DEG), dipropylene glycol (DPG), tripropylene glycol, polypropylene glycol (PPG) and combinations thereof.

In an exemplary embodiment, the first polyol compound may have a weight average molecular weight (Mw) of about 100 g/mol to about 3,000 g/mol, for example, about 100 g/mol to about 2,000 g/mol, for example, about 100 g/mol to about 1,800 g/mol, for example, about 500 g/mol to about 1,500 g/mol, and for example, about 800 g/mol to about 1,200 g/mol.

In an exemplary embodiment, the first polyol compound may include a low molecular weight polyol having a weight average molecular weight (Mw) of about 100 g/mol or more and less than about 300 g/mol and a high molecular weight polyol having a weight average molecular weight (Mw) of about 300 g/mol or more and about 1800 g/mol or less. By appropriately mixing and using the low molecular weight polyol and the high molecular weight polyol having a weight average molecular weight in the above ranges as the first polyol compound, a non-foamed-cured product having an appropriate cross-linked structure from the first urethane-based prepolymer may be formed, and it may be advantageous in securing physical properties such as hardness and optical properties such as light transmission, which the window 102 desires.

The first urethane-based prepolymer may have a weight average molecular weight (Mw) of about 500 g/mol to about 2000 g/mol, for example, about 800 g/mol to about 1,500 g/mol, for example, about 900 g/mol to about 1,200 g/mol, and for example, about 950 g/mol to about 1,100 g/mol. When the first urethane-based prepolymer has a degree of polymerization equivalent to a weight average molecular weight (Mw) in the above-described range, the window composition is non-foam cured under predetermined process conditions, so that it may be more advantageous in forming a window 102 having an appropriate mutual surface hardness relationship with the polishing surface of the polishing layer 10, and through this, polishing is smoothly performed over the polishing surface and the uppermost surface of the window 102, and thus may be advantageous even in terms of preventing leakage.

In an exemplary embodiment, the first isocyanate compound may include an aromatic diisocyanate and an alicyclic diisocyanate. The aromatic diisocyanate may include, for example, 2,4-toluene diisocyanate (2,4-TDI) and 2,6-toluene diisocyanate (2,6-TDI) and the alicyclic diisocyanate may include dicyclohexylmethane diisocyanate ($H_{12}$MDI). Furthermore, the first polyol compound may include, for example, polytetramethylene ether glycol (PTMG), diethylene glycol (DEG) and polypropylene glycol (PPG).

In the window composition, with respect to 100 parts by weight of the total amount of the first isocyanate compound in the entire component for the preparation of the first urethane-based prepolymer, the total amount of the first polyol compound may be about 100 parts by weight to about 250 parts by weight, for example, about 120 parts by weight to about 250 parts by weight, for example, about 120 parts by weight to about 240 parts by weight, for example, about 150 parts by weight to about 240 parts by weight, and for example, about 150 parts by weight to about 200 parts by weight.

In the window composition, the first isocyanate compound includes the aromatic diisocyanate, the aromatic diisocyanate includes 2,4-TDI and 2,6-TDI, and the content of the 2,6-TDI may be about 1 part by weight to about 40 parts by weight, for example, about 1 part by weight to about 30 parts by weight, for example, about 10 parts by weight to about 30 parts by weight, and for example, about 15 parts by weight to about 30 parts by weight, with respect to 100 parts by weight of the 2,4-TDI.

In the window composition, the first isocyanate compound includes the aromatic diisocyanate and the alicyclic diisocyanate, and the total content of the alicyclic diisocyanate may be about 5 parts by weight to about 30 parts by weight, for example, about 10 parts by weight to about 30 parts by weight, and for example, about 15 parts by weight to about 30 parts by weight, with respect to 100 parts by weight of the total content of the aromatic diisocyanate.

When the relative content ratio of each component of the window composition satisfies the above-described ranges individually or simultaneously, the window 102 manufactured therefrom may secure the light transmission required for the end point detection function, and simultaneously, the uppermost surface thereof may have an appropriate surface hardness. Accordingly, the uppermost surface of the window 102 may form an appropriate mutual surface hardness relationship with the polishing surface of the polishing layer 10 prepared from a polishing layer composition in which the relative content ratio of each component satisfies those described below, respectively or simultaneously, and by facilitating the polishing performed repeatedly through the polishing surface and the uppermost surface of the window, it may be more advantageous in effectively preventing a phenomenon of leakage between the side surface of the window 102 and the side surface of the first through hole 101.

In the window composition, the isocyanate group content (NCO %) may be about 6 wt % to about 10 wt %, for example, about 7 wt % to about 9 wt %, and for example, about 7.5 wt % to about 8.5 wt %. The isocyanate group content means a percentage of the weight of an isocyanate group (—NCO) that does not react with urethane and is present as a free reaction group in the total weight of the window composition. The isocyanate group content may be designed by comprehensively adjusting the types and contents of the first isocyanate compound and the first polyol compound for preparing the first urethane-based prepolymer, conditions such as the temperature, pressure and time of a process of preparing the first urethane-based prepolymer, and the types, contents, and the like of additives used for the preparation of the first urethane-based prepolymer. When the isocyanate group content of the window composition satisfies the above range, the window composition may be non-foam cured to secure an appropriate surface hardness, and it may be advantageous in securing an appropriate hardness relationship with the polishing layer in terms of being advantageous in maximizing the leakage prevention effect.

The window composition may further include a curing agent. The curing agent is a compound for chemically reacting with the first urethane-based prepolymer to form a final cured structure in the window, and may include, for example, an amine compound or an alcohol compound. Specifically, the curing agent may include one selected from the group consisting of an aromatic amine, an aliphatic amine, an aromatic alcohol, an aliphatic alcohol and combinations thereof.

The curing agent may include one selected from the group consisting of, for example, 4,4'-methylenebis(2-chloroaniline) (MOCA), diethyltoluene diamine (DETDA), diaminodiphenyl methane, dimethyl thio-toluene diamine (DMTDA), propanediol bis p-aminobenzoate, methylene bis-methyl anthranilate, diaminodiphenylsulfone, m-xylylenediamine, isophoronediamine, ethylenediamine, diethylenetriamine, triethylenetetramine, polypropylene diamine, polypropylene triamine, bis(4-amino-3-chlorophenyl) methane and combinations thereof.

The content of the curing agent may be about 18 parts by weight to about 28 parts by weight, for example, about 19 parts by weight to about 27 parts by weight, and for example, about 20 parts by weight to about 26 parts by weight based on 100 parts by weight of the window composition.

In an exemplary embodiment, the curing agent may include an amine compound, and the molar ratio of an isocyanate group (—NCO) in the window composition to an amine group (—$NH_2$) in the curing agent may be about 1:0.60 to about 1:0.99, for example, about 1:0.60 to about 1:0.95.

As described above, the window may include a non-foamed-cured product of the window composition. Accordingly, the window composition may not include a foaming agent. Since the window composition is subjected to a curing process without a foaming agent, a light transmission required for end point detection may be secured.

The window composition may further include an additive, if necessary. The type of additive may include one selected from the group consisting of a surfactant, a pH adjuster, a binder, an antioxidant, a heat stabilizer, a dispersion stabilizer and combinations thereof. The terms such as 'surfactant' and 'antioxidant' are arbitrary terms based on the main role of the corresponding substance, and each corresponding substance does not necessarily perform only the function limited to the role by the corresponding term.

In an exemplary embodiment, the window 102 may have a light transmittance of about 1% to about 50%, for example, about 30% to about 85%, for example, about 30% to about 70%, for example, about 30% to about 60%, for example, about 1% to about 20%, for example, about 2% to about 20%, and for example, about 4% to about 15% with respect to light having one wavelength in a wavelength range of about 500 nm to about 700 nm with respect to a thickness of 2 mm. The light transmittance of the window may be adjusted by the surface treatment of the window surface, the composition of the window, and the like. The window 102 has such a light transmittance, and simultaneously, the uppermost surface of the window 102 and the polishing surface of the polishing layer 10 have the above-described hardness relationship, so that an excellent leakage prevention effect may be secured.

In an exemplary embodiment, the polishing layer 10 may include a foamed-cured product of a polishing layer composition including a second urethane-based prepolymer. The polishing layer 10 may have a porous structure by including a foamed-cured product, and such a porous structure may perform a function of appropriately securing the fluidity of the polishing slurry applied to the polishing surface and a physical frictional force of a polishing target with a surface to be polished by forming a surface roughness on a polishing surface which cannot be formed by a non-foamed-cured product. The 'prepolymer' means a polymer having a relatively low molecular weight, in which the degree of polymerization is discontinued in an intermediate step so as to facilitate molding in the preparation of a cured product. The prepolymer is subjected to additional curing steps such as heating and/or pressurization as it is, or is mixed with other polymerizable compounds, for example, additional compounds such as heterogeneous monomers or heterogeneous prepolymers, and reacted with each other, and then may be molded as final cured product.

The second urethane-based prepolymer may be prepared by reacting a second isocyanate compound with a second polyol compound. The second isocyanate compound may include one selected from the group consisting of an aromatic diisocyanate, an aliphatic diisocyanate, an alicyclic diisocyanate and combinations thereof. In an exemplary embodiment, the second isocyanate compound may include an aromatic diisocyanate. For example, the second isocyanate compound may include an aromatic diisocyanate and an alicyclic diisocyanate.

The second isocyanate compound may include one selected from the group consisting of, for example, 2,4-toluene diisocyanate (2,4-TDI), 2,6-toluene diisocyanate (2,6-TDI), naphthalene-1,5-diisocyanate, p-phenylene diisocyanate, tolidine diisocyanate, 4,4'-diphenylmethane diisocyanate, hexamethylene diisocyanate, dicyclohexylmethane diisocyanate, 4,4'-dicyclohexylmethane diisocyanate (H12MDI), isoporone diisocyanate and combinations thereof.

The second polyol compound may include one selected from the group consisting of, for example, a polyether-based polyol (polyether polyol), a polyester-based polyol (polyester polyol), a polycarbonate-based polyol (polycarbonate polyol), an acrylic polyol (acryl polyol) and combinations thereof. The 'polyol' means a compound including at least two hydroxyl groups (—OH) per molecule. In an exemplary embodiment, the second polyol compound may include a dihydric alcohol compound having two hydroxyl groups, that is, diol or glycol. In an exemplary embodiment, the second polyol compound may include a polyether-based polyol.

The second polyol compound may include one selected from the group consisting of, for example, polytetramethylene ether glycol (PTMG), polypropylene ether glycol, ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol (DEG), dipropylene glycol (DPG), tripropylene glycol, polypropylene glycol (PPG) and combinations thereof.

In an exemplary embodiment, the second polyol compound may include a low molecular weight polyol having a weight average molecular weight (Mw) of about 100 g/mol or more and less than about 300 g/mol and a high molecular weight polyol having a weight average molecular weight (Mw) of about 300 g/mol or more and about 1800 g/mol or less. By appropriately mixing and using the low molecular weight polyol and the high molecular weight polyol having a weight average molecular weight in the above ranges as the second polyol compound, a foamed-cured product having an appropriate cross-linked structure from the second urethane-based prepolymer may be formed, and it may be advantageous in forming a foamed structure having physical properties such as hardness and pores with a suitable size, which the polishing layer 10 desires.

The second urethane-based prepolymer may have a weight average molecular weight (Mw) of about 500 g/mol to about 3,000 g/mol, for example, about 600 g/mol to about 2,000 g/mol, and for example, about 800 g/mol to about 1,000 g/mol. When the second urethane-based prepolymer has a degree of polymerization equivalent to a weight average molecular weight (Mw) in the above-described range, the polishing layer composition is foam cured under predetermined process conditions, so that it may be more advantageous in forming a polishing layer 10 having a polishing surface having an appropriate mutual surface hardness relationship with the uppermost surface of the window 102, and through this, polishing is smoothly performed over the polishing surface and the uppermost surface of the window 102, and thus may be advantageous even in terms of preventing leakage through the interface between the window 102 and the polishing layer 10.

In an exemplary embodiment, the second isocyanate compound may include an aromatic diisocyanate and an alicyclic diisocyanate. The aromatic diisocyanate may include, for example, 2,4-toluene diisocyanate (2,4-TDI) and 2,6-toluene diisocyanate (2,6-TDI) and the alicyclic diisocyanate may include dicyclohexylmethane diisocyanate (H12MDI). Furthermore, the second polyol compound may include, for example, polytetramethylene ether glycol (PTMG) and diethylene glycol (DEG).

In the polishing layer composition, with respect to 100 parts by weight of the total amount of the second isocyanate compound in the entire component for the preparation of the second urethane-based prepolymer, the total amount of the second polyol compound may be about 100 parts by weight to about 250 parts by weight, for example, about 110 parts by weight to about 250 parts by weight, for example, about 110 parts by weight to about 240 parts by weight, for example, about 110 parts by weight to about 200 parts by weight, for example, about 110 parts by weight to about 180 parts by weight, and for example, about 110 parts by weight or more and less than about 150 parts by weight.

In the polishing layer composition, the second isocyanate compound includes the aromatic diisocyanate, the aromatic diisocyanate includes 2,4-TDI and 2,6-TDI, and the content of the 2,6-TDI may be about 1 part by weight to about 40 parts by weight, for example, about 1 part by weight to about 30 parts by weight, for example, about 10 parts by weight to about 30 parts by weight, and for example, about 15 parts by weight to about 30 parts by weight, with respect to 100 parts by weight of the 2,4-TDI.

In the polishing layer composition, the second isocyanate compound includes the aromatic diisocyanate and the alicyclic diisocyanate, and the total content of the alicyclic diisocyanate may be about 5 parts by weight to about 30 parts by weight, for example, about 5 parts by weight to about 25 parts by weight, for example, about 5 parts by weight to about 20 parts by weight, and for example, about 5 parts by weight or more and less than about 15 parts by weight, with respect to 100 parts by weight of the total content of the aromatic diisocyanate.

When the relative content ratio of each component of the polishing layer composition satisfies the above-described ranges individually or simultaneously, the polishing surface of the polishing layer 10 manufactured therefrom may have an appropriate porous structure and an appropriate surface hardness. Accordingly, the polishing surface of the polishing layer 10 may form an appropriate mutual surface hardness relationship with the uppermost surface of the window 102 in which the relative content ratio of each component satisfies those described above individually or simultaneously, and as a result, polishing performed over the polishing surface and the uppermost surface of the window 102 is facilitated, so that it may be advantageous even in terms of preventing leakage through the interface between the window 102 and the polishing layer 10.

In the polishing layer composition, the isocyanate group content (NCO %) may be about 6 wt % to about 12 wt %, for example, about 6 wt % to about 10 wt %, and for example, about 6 wt % to about 9 wt %. The isocyanate group content means a percentage of the weight of an isocyanate group (—NCO) that does not react with urethane and is present as a free reaction group in the total weight of the preliminary composition. The isocyanate group content may be designed by comprehensively adjusting the types and contents of the second isocyanate compound and the second polyol compound for preparing the second urethane-based prepolymer, conditions such as the temperature, pressure and time of a process of preparing the second urethane-based prepolymer, and the types, contents, and the like of additives used for the preparation of the second urethane-based prepolymer. When the isocyanate group content of the polishing layer composition satisfies the above range, the polishing layer composition is foam cured under predetermined process conditions, so that it may be more advantageous in forming a polishing layer 10 having a polishing surface having an appropriate mutual surface hardness relationship with the uppermost surface of the window 102, and through this, polishing is smoothly performed over the polishing surface and the uppermost surface of the window 102, and thus may be advantageous even in terms of preventing leakage through the interface between the window 102 and the polishing layer 10.

The polishing layer composition may further include a curing agent. The curing agent is a compound for chemically reacting with the second urethane-based prepolymer to form a final cured structure in the polishing layer, and may include, for example, an amine compound or an alcohol compound. Specifically, the curing agent may include one selected from the group consisting of an aromatic amine, an aliphatic amine, an aromatic alcohol, an aliphatic alcohol and combinations thereof.

The curing agent may include one selected from the group consisting of, for example, 4,4'-methylenebis(2-chloroaniline) (MOCA), diethyltoluene diamine (DETDA), diaminodiphenyl methane, dimethyl thio-toluene diamine (DMTDA), propanediol bis p-aminobenzoate, methylene bis-methyl anthranilate, diaminodiphenylsulfone, m-xylylenediamine, isophoronediamine, ethylenediamine, diethylenetriamine, triethylenetetramine, polypropylene diamine, polypropylene triamine, bis(4-amino-3-chlorophenyl) methane and combinations thereof.

The content of the curing agent may be about 18 parts by weight to about 28 parts by weight, for example, about 19 parts by weight to about 27 parts by weight, and for example, about 20 parts by weight to about 26 parts by weight based on 100 parts by weight of the polishing layer composition.

In an exemplary embodiment, the curing agent may include an amine compound, and the molar ratio of an isocyanate group (—NCO) in the polishing layer composition to an amine group (—$NH_2$) in the curing agent may be about 1:0.60 to about 1:0.99, for example, about 1:0.60 to about 1:0.95.

The polishing layer composition may further include a foaming agent. The foaming agent is a component for forming a porous structure in the polishing layer, and may include one selected from the group consisting of a solid phase foaming agent, a gas phase foaming agent, a liquid phase foaming agent and combinations thereof. In an exemplary embodiment, the foaming agent may include a solid phase foaming agent, a gas phase foaming agent or combinations thereof.

The solid phase foaming agent may have an average particle diameter of about 5 μm to about 200 μm, for example, about 20 μm to about 50 μm, for example, about 21 μm to about 50 μm, and for example, about 21 μm to about 40 μm. The average particle diameter of the solid phase foaming agent means the average particle diameter of the thermally expanded particles themselves when the solid phase foaming agent is a thermally expanded particle as described below, and may mean the average particle diameter of the particles after being expanded by heat or pressure when the solid phase foaming agent is an unexpanded particle as described below.

The solid phase foaming agent may include expandable particles. The expandable particles are particles having a property of being able to expand by heat or pressure, and the size in a final polishing layer may be determined by the heat, pressure or the like applied in the process of manufacturing the polishing layer. The expandable particles may include thermally expanded particles, unexpanded particles, or combinations thereof. The thermally expanded particles are particles that have been pre-expanded by heat, and mean particles whose size change by heat or pressure applied in the process of manufacturing the polishing layer is small or rarely noticeable. The unexpanded particles are unexpanded particles, and mean particles whose final size is determined by expansion by heat or pressure applied in the manufacturing process of the polishing layer.

The expandable particles may include a resin material outer skin; and an expansion-inducing component present in the inside enclosed in the outer skin.

For example, the outer skin may include a thermoplastic resin, and the thermoplastic resin may be one selected from the group consisting of a vinylidene chloride-based copolymer, an acrylonitrile-based copolymer, a methacrylonitrile-based copolymer, and an acrylic copolymer.

The expansion-inducing component may include one selected from the group consisting of a hydrocarbon compound, a chlorofluoro compound, a tetraalkylsilane compound and combinations thereof.

Specifically, the hydrocarbon compound may include one selected from the group consisting of ethane, ethylene, propane, propene, n-butane, isobutene, n-butene, isobutene, n-pentane, isopentane, neopentane, n-hexane, heptane, petroleum ether and combinations thereof.

The chlorofluoro compound may include one selected from the group consisting of trichlorofluoromethane ($CCl_3F$), dichlorodifluoromethane ($CCl_2F_2$), chlorotrifluoromethane ($CClF_3$), tetrafluoroethylene ($CClF_2$-$CClF_2$) and combinations thereof.

The tetraalkylsilane compound may include one selected from the group consisting of tetramethylsilane, trimethylethylsilane, trimethylisopropylsilane, trimethyl-n-propylsilane and combinations thereof.

The solid phase foaming agent may selectively include particles treated with an inorganic component. For example, the solid phase foaming agent may include expandable particles treated with an inorganic component. In an exemplary embodiment, the solid phase foaming agent may include expandable particles treated with silica ($SiO_2$) particles. The treatment of the inorganic component of the solid phase foaming agent may prevent agglomeration between a plurality of particles. The solid phase foaming agent treated with an inorganic component may have different chemical, electrical and/or physical properties on the surface of the foaming agent from those of a solid phase foaming agent not treated with an inorganic component.

The content of the solid phase foaming agent may be about 0.5 part by weight to about 10 parts by weight, for example, about 1 part by weight to about 3 parts by weight, for example, about 1.3 parts by weight to about 2.7 parts by weight, and for example, about 1.3 parts by weight to about 2.6 parts by weight, based on 100 parts by weight of the urethane-based prepolymer.

The type and content of the solid phase foaming agent may be designed according to the target porous structure and physical properties of the polishing layer.

The gas phase foaming agent may include an inert gas. The gas phase foaming agent is introduced during the process of a reaction between the second urethane-based prepolymer and the curing agent, and thus may be used as a pore-forming element.

The type of inert gas is not particularly limited as long as it is a gas that does not participate in the reaction between the second urethane-based prepolymer and the curing agent. For example, the inert gas may include one selected from the group consisting of nitrogen gas ($N_2$), argon gas (Ar), helium gas (He) and combinations thereof. Specifically, the inert gas may include nitrogen gas ($N_2$) or argon gas (Ar).

The type and content of the gas phase foaming agent may be designed according to the target porous structure and physical properties of the polishing layer.

In an exemplary embodiment, the foaming agent may include a solid phase foaming agent. For example, the foaming agent may be composed only of a solid phase foaming agent.

The solid phase foaming agent may include expandable particles, and the expandable particles may include thermally expanded particles. For example, the solid phase foaming agent may be composed only of thermally expanded particles. When the solid phase foaming agent is composed only of thermally expanded particles without including the unexpanded particles, it may be advantageous in implementing uniform porous characteristics over the entire region of the polishing layer because the variability of the pore structure is reduced, but the predictability is increased.

In an exemplary embodiment, the thermally expanded particles may be particles having an average particle diameter of about 5 μm to about 200 μm. The thermally expanded particles may have an average particle diameter of about 5 μm to about 100 μm, for example, about 10 μm to about 80 μm, for example, about 20 μm to about 70 μm, for example, about 20 μm to about 50 μm, for example, about 30 μm to about 70 μm, for example, about 25 μm to 45 μm, for example, about 40 μm to about 70 μm, and for example, about 40 μm to about 60 μm. The average particle diameter is defined as D50 of the thermally expanded particles.

In an exemplary embodiment, the thermally expanded particles may have a density of about 30 $kg/m^3$ to about 80 $kg/m^3$, for example, about 35 $kg/m^3$ to about 80 $kg/m^3$, for example, about 35 $kg/m^3$ to about 75 $kg/m^3$, for example, about 38 $kg/m^3$ to about 72 $kg/m^3$, for example, about 40 $kg/m^3$ to about 75 $kg/m^3$, and for example, about 40 $kg/m^3$ to about 72 $kg/m^3$.

In an exemplary embodiment, the foaming agent may include a gas phase foaming agent. For example, the foaming agent may include a solid phase foaming agent and a gas phase foaming agent. The matters on the solid phase foaming agent are as described above.

The gas phase foaming agent may be injected through a predetermined injection line during the process of mixing the second urethane-based prepolymer, the solid phase foaming agent and the curing agent. The gas phase foaming agent may have an injection rate of about 0.8 L/min to about 2.0 L/min, for example, about 0.8 L/min to about 1.8 L/min, for example, about 0.8 L/min to about 1.7 L/min, for example, about 1.0 L/min to about 2.0 L/min, for example, about 1.0 L/min to about 1.8 L/min, and for example, about 1.0 L/min to about 1.7 L/min.

The polishing layer composition may further include an additive, if necessary. The type of additive may include one selected from the group consisting of a surfactant, a pH adjuster, a binder, an antioxidant, a heat stabilizer, a dispersion stabilizer and combinations thereof. The terms such as 'surfactant' and 'antioxidant' are arbitrary terms based on the main role of the corresponding substance, and each corresponding substance does not necessarily perform only the function limited to the role by the corresponding term.

The surfactant is not particularly limited as long as it is a substance that serves to prevent a phenomenon such as aggregation or superposition of pores. For example, the surfactant may include a silicon-based surfactant.

The surfactant may be used in a content of about 0.2 part by weight to about 2 parts by weight based on 100 parts by weight of the second urethane-based prepolymer. Specifically, the surfactant may be included in a content of about 0.2 part by weight to about 1.9 parts by weight, for example, about 0.2 part by weight to about 1.8 parts by weight, for example, about 0.2 part by weight to about 1.7 parts by weight, for example, about 0.2 part by weight to about 1.6 parts by weight, for example, about 0.2 part by weight to about 1.5 parts by weight, and for example, about 0.5 part by weight to 1.5 parts by weight, based on 100 parts by weight of the second urethane-based prepolymer. When the surfactant is included in a content within the above range, the pores derived from the gas phase foaming agent may be stably formed and maintained in a mold.

The reaction rate regulator serves to promote or delay the reaction, and a reaction promoter, a reaction retarder, or all of them may be used depending on the purpose. The reaction rate modifier may include a reaction promoter. For example, the reaction promoter may be one or more reaction promoters selected from the group consisting of a tertiary amine-based compound and an organic metal-based compound.

Specifically, the reaction rate modifier may include one or more selected from the group consisting of triethylenediamine, dimethylethanolamine, tetramethylbutanediamine, 2-methyl-triethylenediamine, dimethylcyclohexylamine, triethylamine, triisopropanolamine, 1,4-diazabicyclo(2,2,2)octane, bis(2-methylaminoethyl) ether, trimethylaminoethylethanolamine, N,N,N,N,N"-pentamethyldiethylenetriamine, dimethylaminoethylamine, dimethylaminopropylamine, benzyldimethylamine, N-ethylmorpholine, N,N-dimethylaminoethylmorpholine, N,N-dimethylcyclohexylamine, 2-methyl-2-azanobonane, dibutyltin dilaurate, stannous octoate, dibutyltin diacetate, dioctyltin diacetate, dibutyltin maleate, dibutyltin di-2-ethylhexanoate and dibutyltin dimercaptide. Specifically, the reaction rate modifier may include one or more selected from the group consisting of benzyldimethylamine, N,N-dimethylcyclohexylamine and triethylamine.

The reaction rate modifier may be used in an amount of about 0.05 part by weight to about 2 parts by weight, for example, about 0.05 part by weight to about 1.8 parts by weight, for example, about 0.05 part by weight to about 1.7 parts by weight, for example, about 0.05 part by weight to about 1.6 parts by weight, for example, about 0.1 part by weight to about 1.5 parts by weight, for example, about 0.1 part by weight to about 0.3 part by weight, for example, about 0.2 part by weight to about 1.8 parts by weight, for example, about 0.2 part by weight to about 1.7 parts by weight, for example, about 0.2 part by weight to about 1.6 parts by weight, for example, about 0.2 part by weight to about 1.5 parts by weight, and for example, about 0.5 part by weight to about 1 part by weight, based on 100 parts by weight of the second urethane-based prepolymer. When the reaction rate modifier is used in the above-described content range, a polishing layer having pores with a desired size and hardness may be formed by appropriately adjusting the curing reaction rate of the preliminary composition.

In an exemplary embodiment, the polishing layer may have a density of about 0.50 g/cm$^3$ to about 1.20 g/cm$^3$, for example, about 0.50 g/cm$^3$ to about 1.10 g/cm$^3$, for example, about 0.50 g/cm$^3$ to about 1.00 g/cm$^3$, for example, about 0.60 g/cm$^3$ to about 0.90 g/cm$^3$, and for example, about 0.70 g/cm$^3$ to about 0.90 g/cm$^3$. The polishing layer 10 having a density satisfying the above range may provide a polishing surface having appropriate mechanical properties to a polishing target through the polishing surface thereof, and as a result, it may be advantageous in effectively preventing the occurrence of defects such as scratch while implementing the excellent polishing flatness of the surface to be polished. Further, since the physical properties of the polishing layer 10 are excellent in the mechanical and physical properties and compatibility of the window 102, it may be more advantageous in terms of preventing leakage by minimizing the occurrence of a leak between the polishing layer 10 and the window 102.

In an exemplary embodiment, the polishing layer 10 may have a tensile strength of about 15 N/mm$^2$ to about 30 N/mm$^2$, for example, about 15 N/mm$^2$ to about 28 N/mm$^2$, for example, about 15 N/mm$^2$ to about 27 N/mm$^2$, for example, about 17 N/mm$^2$ to about 27 N/mm$^2$, and for example, about 20 N/mm$^2$ to about 27 N/mm$^2$. The tensile strength was derived by processing the polishing layer to a thickness of 2 mm, cutting the width and length to a size of 4 cm×1 cm to prepare a sample, and then measuring the maximum strength value immediately prior to fracture at a rate of 50 mm/minute using a universal testing machine (UTM) for the sample. The polishing layer 10 having a tensile strength satisfying the above range may provide a polishing surface having appropriate mechanical properties to a polishing target through the polishing surface thereof, and as a result, it may be advantageous in effectively preventing the occurrence of defects such as a scratch while implementing excellent polishing flatness of the surface to be polished. Further, since the physical properties of the polishing layer 10 are excellent in mechanical and physical properties and compatibility of the window 102, it may be more advantageous in terms of preventing leakage by minimizing the occurrence of a leak between the polishing layer 10 and the window 102.

In an exemplary embodiment, the elongation of the polishing layer 10 may be about 100% or more, for example, about 100% to about 200%, and for example, about 110% to about 160%. The elongation was derived by processing the polishing layer to a thickness of 2 mm, cutting the width and length to a size of 4 cm×1 cm to prepare a sample, then measuring the maximum deformation length immediately prior to fracture at a rate of 50 mm/minute using a universal testing machine (UTM) for the sample, and then expressing the ratio of the maximum deformation length to the initial length as a percentage (%). The polishing layer 10 having an elongation satisfying the above range may provide a polishing surface having appropriate mechanical properties to a polishing target through the polishing surface thereof, and as a result, it may be advantageous in effectively preventing the occurrence of defects such as a scratch while implementing excellent polishing flatness of the surface to be polished. Further, since the physical properties of the polishing layer 10 are excellent in the mechanical and physical properties and compatibility of the window 102, it may be more advantageous in terms of preventing leakage by minimizing the occurrence of a leak between the polishing layer 10 and the window 102.

The support layer 20 provides the polishing pad 100 with an improved leakage prevention function by including the compressed region (CR) as described above, and simultaneously, may serve as a buffer that cushions external pressure or impact that can be transmitted to the surface to be polished during the polishing process through the non-compression portion (NCR).

The support layer (20) may include a non-woven fabric or suede, but is not limited thereto. In an exemplary embodiment, the support layer 20 may include a non-woven fabric. The 'non-woven fabric' means a three-dimensional network structure of fibers that are not woven. Specifically, the support layer 20 may include a non-woven fabric and a resin impregnated in the non-woven fabric.

The non-woven fabric may be a non-woven fabric of fibers including one selected from the group consisting of, for example, polyester fibers, polyamide fibers, polypropylene fibers, polyethylene fibers and combinations thereof.

The resin impregnated in the non-woven fabric may include one selected from the group consisting of, for example, a polyurethane resin, a polybutadiene resin, a styrene-butadiene copolymer resin, a styrene-butadiene-styrene copolymer resin, an acrylonitrile-butadiene copolymer resin, a styrene-ethylene-butadiene-styrene copolymer resin, a silicone rubber resin, a polyester-based elastomer resin, a polyamide-based elastomer resin and combinations thereof.

In an exemplary embodiment, the support layer 20 may include a non-woven fabric of fibers including polyester fibers impregnated with a resin including a polyurethane resin. In this case, in a vicinity region where the window 30 is disposed, an excellent supporting performance of the window 30 of the support layer 20 may be implemented, and in the implementation of the function of loading debris by the void 15, it may be advantageous that the uppermost surface of the support layer 20 safely loads the loaded debris without being leaked.

The support layer 20 may have a thickness of for example, about 0.5 mm to about 2.5 mm, for example, about 0.8 mm to about 2.5 mm, for example, about 1.0 mm to about 2.5 mm, for example, about 1.0 mm to about 2.0 mm, and for example, about 1.2 mm to about 1.8 mm. Referring to FIG. 2, the thickness of the support layer 20 may be the thickness (H1) of the non-compression region (NCR).

The surface of the support layer 20, for example, the third surface 21 may have an Askier C hardness of about 60 to about 80, for example, about 65 to about 80. When the surface hardness on the third surface 21 satisfies the above range as the Asker C hardness, support rigidity for supporting the polishing layer 10 may be sufficiently secured, and excellent interfacial adhesion with the second surface 21 may be exhibited through the second adhesive layer 40.

The support layer may have a density of about 0.10 g/cm$^3$ to about 1.00 g/cm$^3$, for example, about 0.10 g/cm$^3$ to about 0.80 g/cm$^3$, for example, about 0.10 g/cm$^3$ to about 0.70 g/cm$^3$, for example, about 0.10 g/cm$^3$ to about 0.60 g/cm$^3$, for example, about 0.10 g/cm$^3$ to about 0.50 g/cm$^3$, and for example, about 0.20 g/cm$^3$ to about 0.40 g/cm$^3$. The support layer 20 having a density satisfying the above range has an excellent cushioning effect based on the high elastic force of the non-compression portion (NCR), and the compressed portion (CR) is compressed at a predetermined compressibility compared to the non-compression portion (NCR), and thus may be more advantageous in forming a high-density region.

The support layer 20 may have a compressibility of about 1% to about 20%, for example, about 3% to about 15%, for example, about 5% to about 15%, and for example, about 6% to about 14%. For the compressibility, the thickness of a cushion layer was measured when the support layer was cut into a width×length of 5 cm×5 cm (thickness: 2 mm) and a stress load of 85 g was maintained for 30 seconds in a no-load state, and was called T1 (mm), the thickness of the support layer was measured when a stress load of 800 g was additionally applied from the T1 state and maintained for 3 minutes, and was called T2 (mm), and then the compressibility was calculated by an equation of (T1−T2)/T1*100. When the support layer 20 satisfies the compressibility measured under the above conditions within the above-described range, it may be more advantageous that the compressed region (CR) forms a high-density region effective for preventing leakage.

The support layer 20 may have a compressive modulus of about 60% to about 95%, for example, about 70% to about 95%, and for example, about 70% to about 92%. For the compressive modulus, the thickness of a cushion layer was measured when the support layer was cut into a width× length of 5 cm×5 cm (thickness: 2 mm) and a stress load of 85 g was maintained for 30 seconds in a no-load state, and was called T1 (mm), the thickness of the support layer was measured when a stress load of 800 g was additionally applied from the T1 state and maintained for 3 minutes, and was called T2 (mm), and then when the thickness of the support layer was called T3 when a stress load of 800 g was removed from the T2 state and restored while maintaining a stress load of 85 g for 1 minute, the compressive modulus was calculated by an equation of (T3−T2)/(T1−T2)*100. When the support layer 20 satisfies the compressive modulus measured under the above conditions within the above-described range, it may be more advantageous that the compressed region (CR) forms a high-density region effective for preventing leakage, and simultaneously, it may be more advantageous that the elastic force of the support layer 20 has an effect of preventing defects on the surface to be polished and improves the polishing flatness.

The polishing pads 100, 100', and 200 according to an exemplary embodiment may have an air leak value of less than about $1\times10^{-2}$ cc/min (0.001=1 mbar), for example, less than about $1\times10^{-3}$ cc/min (0.001=1 mbar). FIG. 7 schematically illustrates a process of measuring the air leak of the polishing pad. Referring to FIG. 7, the air leak value was derived by positioning and sealing a holder 300 in a region corresponding to the outer perimeter of the window on the lower surface of the support layer with respect to the polishing pad, then reducing pressure under a condition of −1 bar for 5 seconds, maintaining and stabilizing the decompression state for 10 seconds, and then measuring the amount of change in pressure.

In another exemplary embodiment of the present invention, provided is a method for manufacturing a semiconductor device, the method including: providing a polishing pad provided with a polishing layer including a first surface which is a polishing surface and a second surface which is an opposite surface thereof, including a first through hole passing through the first surface and the second surface, and including a window disposed in the first through hole; and disposing a surface to be polished in a polishing target so as to be brought into contact with the first surface, and then polishing the polishing target while rotating the polishing pad and the polishing target relative to each other under pressurized conditions, in which the polishing target includes a semiconductor substrate, the polishing pad further includes a support layer disposed at the second surface of the polishing layer, the support layer includes a third surface and a fourth surface which is an opposite surface thereof at the polishing layer and includes a second through hole connected to the first through hole while passing through the third surface and the fourth surface, the second through hole is smaller than the first through hole, a lowermost surface of the window is supported by the third surface, a first adhesive layer is included between the lowermost surface of the window and the third surface, a second adhesive layer is included between the second surface and the third surface; and between the lowermost surface of the window and the third surface, and the support layer includes a compressed region in a region corresponding to the lowermost surface of the window.

In the method for manufacturing a semiconductor device, for all the matters on the polishing pad, all the matters described for the description of the above-described exemplary embodiments not only when the polishing pad is repeatedly described below, but also even though the polishing pad is not repeatedly described below, and the technical advantages thereof may be integrated and applied in the same manner below. By applying the polishing pad having the above-described characteristics to the method for manufacturing a semiconductor device, the semiconductor device manufactured through the polishing pad can secure high quality based on the excellent polishing result of the semiconductor substrate.

FIG. 8 is a schematic view schematically illustrating the method for manufacturing a semiconductor device according to an exemplary embodiment. Referring to FIG. 8, the polishing pad 100 may be provided on the surface plate 120. Referring to FIGS. 2 and 8, the polishing pad 100 may be provided on the surface plate 120 such that the second surface 12 side of the polishing layer 10 faces the surface plate 120. In yet another aspect, the polishing pad 100 may be disposed on the surface plate 120 such that the uppermost surface of the window 120 and the first surface 11 which is the polishing surface are exposed to the outermost surface.

The polishing target includes a semiconductor substrate 130. The semiconductor substrate 130 may be disposed such that a surface to be polished of the semiconductor substrate 130 is brought into contact with the first surface 11 and the uppermost surface of the window 102. The surface to be polished of the semiconductor substrate 130 may be directly brought into contact with the first surface 11 and the uppermost surface of the window 102, and indirectly brought into contact with the first surface 11 and the uppermost surface of the window 102 using a fluid slurry or the like as a medium. In the present specification, 'brought into contact' is interpreted to include all cases of being brought into direct or indirect contact.

The semiconductor substrate 130 may be rotationally polished in contact with the first surface 11 and the uppermost surface of the window 102 while the surface to be polished is pressurized under a predetermined load in a state of being mounted to a polishing head 160 so as to face the polishing pad 100. The load applied to the surface to be polished of the semiconductor substrate 130 with respect to the first surface 11 may be selected depending on the purpose, for example, in a range of about 0.01 psi to about 20 psi, and may be, for example, about 0.1 psi to about 15 psi, but is not limited thereto. When the surface to be polished of the semiconductor substrate 130 is rotationally polished while being brought into contact with the first surface 11 and the uppermost surface of the window 102 under a load in the above-described range, in the process of repeatedly reciprocating between the first surface 11 and the uppermost surface of the window 102, it may be more advantageous in terms of securing the effect of preventing leakage through the interface between the first surface 11 and the uppermost surface of the window 102.

The semiconductor substrate 130 and the polishing pad 100 may be rotated relative to each other while a surface to be polished and the polishing surface are brought into contact with each other. In this case, the rotation direction of the semiconductor substrate 130 and the rotation direction of the polishing pad 100 may be the same direction or may be opposite directions. In the present specification, 'relative rotation' is interpreted to include all rotations in the same direction or in opposite directions. The polishing pad 100 is rotated by rotating the surface plate 120 while being mounted on the surface plate 120, and the semiconductor substrate 130 is rotated by rotating the polishing head 160 while being mounted to the polishing head 160. The rotation speed of the polishing pad 100 may be selected in a range of about 10 rpm to about 500 rpm depending on the purpose, and may be, for example, about 30 rpm to about 200 rpm, but is not limited thereto. The rotation speed of the semiconductor substrate 130 may be about 10 rpm to about 500 rpm, for example, about 30 rpm to about 200 rpm, for example, about 50 rpm to about 150 rpm, for example, about 50 rpm to about 100 rpm, and for example, about 50 rpm to about 90 rpm, but is not limited thereto. When the rotation speeds of the semiconductor substrate 130 and the polishing pad 100 satisfy the above ranges, the fluidity of the slurry due to the centrifugal force thereof may be appropriately secured in relation to the leakage prevention effect through the interface between the uppermost surface of the window 102 and the first surface 11. That is, when the polishing slurry moves on the first surface 11 and the uppermost surface of the window 102 at an appropriate flow rate, it may be more advantageous in terms that the amount of polishing slurry leaking through the interface between the uppermost surface of the window 102 and the first surface 11 maximizes the leakage prevention effect of the polishing pad 100 provided with both the multi-stage adhesive layer structure of the first adhesive layer 30 and the second adhesive layer 40 and the compressed region structure of the support layer 20.

The method for manufacturing a semiconductor device may further supplying a polishing slurry 150 on the first surface 11. For example, the polishing slurry 150 may be sprayed on the first surface 11 through a supply nozzle 140. The flow rate of the polishing slurry 150 sprayed through the supply nozzle 140 may be, for example, about 10 ml/min to about 1,000 ml/min, for example, about 10 ml/min to about 800 ml/min, and for example, about 50 ml/min or about 500 ml/min, but is not limited thereto. When the polishing slurry moves on the first surface 11 and the uppermost surface of the window 102 at an appropriate flow rate by satisfying the spray flow rate of the polishing slurry 150 in the above range, it may be more advantageous in terms that the amount of polishing slurry leaking through the interface between the uppermost surface of the window 102 and the first surface 11 maximizes the leakage prevention effect of the polishing pad 100 provided with both the multi-stage adhesive layer structure of the first adhesive layer 30 and the second adhesive layer 40 and the compressed region structure of the support layer 20.

The polishing slurry 150 may include polishing particles, and the polishing particles may include, for example, silica particles or ceria particles, but are not limited thereto.

The method for manufacturing a semiconductor device may further include processing the first surface 11 through a conditioner 170. The processing of the first surface 11 through the conditioner 170 may be performed simultaneously with polishing the semiconductor substrate 130.

The conditioner 170 may process the first surface 11 while rotating. The rotation speed of the conditioner 170 may be, for example, about 50 rpm to about 150 rpm, for example, about 50 rpm to about 120 rpm, and for example, about 90 rpm to about 120 rpm.

The conditioner 170 may process the first surface 11 while applying pressure to the first surface 11. The pressurization load on the first surface 11 of the conditioner 170 may be, for example, about 1 lb to about 10 lb, for example, about 3 lb to about 9 lb.

The conditioner 170 may process the first surface 11 while vibrating in a pass reciprocating from the center of the polishing pad 100 to the end of the polishing pad 100. When the reciprocation from the center of the polishing pad 100 to the end of the polishing pad 100 by the vibrational motion of the conditioner 170 is calculated as one time, the vibrational motion speed of the conditioner 170 may be about 10 times/min to about 30 times/min, for example, about 10 times/min to about 25 times/min, and for example, about 15 times/min to about 25 times/min.

Since the first surface 11, which is a polishing surface, is polished under a condition that the semiconductor substrate 130 is pressurized with respect to the polishing surface while the polishing is performed, the first surface 11 is gradually changed in a state unsuitable for polishing, such as the reduction in surface roughness while the porous structure which is exposed to the surface, and the like are pressed down. In order to prevent this, the first surface 11 may be maintained in a surface state suitable for polishing while being cut through the conditioner 170 provided with a surface that can be roughened. In this case, when the cut portions of the first surface 11 are not discharged quickly and remains on the polishing surface as debris, the cut portions may cause defects such as scratches on the surface to be polished of the semiconductor substrate 130. From this point of view, when the conditioner 170 driving conditions, that is, the rotation speed, the pressurizing condition, and the like satisfy the above ranges, the surface structure of the first surface 11 may be maintained so as to sustain an excellent leakage prevention effect of the polishing pad 100, and simultaneously, it may be advantageous in terms of securing the defect prevention effect with respect to the surface to be polished of the semiconductor substrate 130.

The method for manufacturing a semiconductor device may further include detecting a polishing end point of the surface to be polished of the semiconductor substrate 130 by reciprocating the light emitted from a light source 180 through the window 102. Referring to FIGS. 2 and 8, the second through hole 201 may be connected to the first through hole 101 to secure a light-pass in which the light emitted from the light source 180 passes through the entire thickness from the uppermost surface to the lowermost surface of the polishing pad 100, and an optical end point detection method through the window 102 may be applied.

As described above, the polishing process to which the polishing pad 100 is applied is performed while supplying a fluid such as a liquid slurry onto the first surface 11, and in this case, components derived from such a fluid may flow into the interface between the window 102 and the first surface 11. When the fluid component thus permeated passes through the second through hole 201 and flows into the lower stage of the polishing pad 100 and the surface plate 120, there is a concern of cause the light source 180 to fail or interfering with the accurate end point detection because moisture may accumulate on the lowermost surface of the window 102. From this point of view, the polishing pad 100 forms the second through hole 201 smaller than the first through hole 101 to secure a support surface of the window 102 on the third surface 21, and simultaneously, a multi-stage adhesive layer including the first adhesive layer 30 and the second adhesive layer 40 is formed on the support surface, and by providing a compressed region (CR) in a region corresponding to the lowermost surface of the window 102 of the support layer 20, it is possible to effectively prevent a fluid component derived from the polishing slurry 150 or the like from flowing into the lower stage of the surface plate 120 or inducing a phenomenon in which moisture accumulates on the lowermost surface of the window 102.

Hereinafter, specific examples of the present invention will be suggested. However, the examples described below are merely for exemplifying or describing the present invention in detail, the scope of the present invention is not limited and interpreted thereby, and the scope of the present invention is determined by the claims.

PREPARATION EXAMPLES

Preparation Example 1: Preparation of Polishing Layer Composition

With respect to a total of 100 parts by weight of a diisocyanate component, 72 parts by weight of 2,4-TDI, 18 parts by weight of 2,6-TDI and 10 parts by weight of $H_{12}$MDI were mixed. With respect to a total of 100 parts by weight of a polyol component, 90 parts by weight of PTMG and 10 parts by weight of DEG were mixed. A mixed raw material was prepared by mixing 148 parts by weight of the polyol component with respect to a total of 100 parts by weight of the diisocyanate component. The mixed raw material was introduced into a 4-necked flask and then reacted at 80° C. to prepare a polishing layer composition including a urethane-based prepolymer and having an isocyanate group content (NCO %) of 9.3 wt %.

Preparation Example 2: Preparation of Window Composition

With respect to a total of 100 parts by weight of a diisocyanate component, 64 parts by weight of 2,4-TDI, 16 parts by weight of 2,6-TDI and 20 parts by weight of $H_{12}$MDI were mixed. With respect to a total of 100 parts by weight of a polyol component, 47 parts by weight of PTMG, 47 parts by weight of PPG and 6 parts by weight of DEG were mixed. A mixed raw material was prepared by mixing 180 parts by weight of the polyol component with respect to a total of 100 parts by weight of the diisocyanate component. The mixed raw material was introduced into a 4-necked flask and then reacted at 80° C. to prepare a window composition including a urethane-based prepolymer and having an isocyanate group content (NCO %) of 8 wt %.

EXAMPLES AND COMPARATIVE EXAMPLES

Example 1

1.0 part by weight of a solid phase foaming agent (Nouryon) was mixed with 100 parts by weight of the polishing layer composition of Preparation Example 1, and 4,4'-methylenebis (2-chloroaniline) (MOCA) was mixed as a curing agent, such that the molar ratio of an amine group (—$NH_2$) of the MOCA was 0.95 compared to 1.0 of an isocyanate group (—NCO) in the polishing layer composition. The polishing layer composition was injected into a mold having a width of 1,000 mm, a length of 1,000 mm, and a height of 3 mm and preheated at 90° C. and at a discharge rate of 10 kg/min, and simultaneously, nitrogen ($N_2$) gas as a gas phase foaming agent was injected at an injection rate of 1.0 L/min. Subsequently, the preliminary composition was subjected to a post-curing reaction under a temperature condition of 110° C. to prepare a polishing layer. The polishing layer was turned to a thickness of 2.03 mm, and a groove having a concentric circular structure with a depth of 460 μm, a width of 0.85 mm and a pitch of 3.0 mm was processed on the polishing surface.

4,4'-methylenebis (2-chloroaniline) (MOCA) as a curing agent was mixed with 100 parts by weight of the window composition of Preparation Example 2, such that the molar ratio of an amine group (—$NH_2$) of the MOCA was 0.95 compared to 1.0 of an isocyanate group (—NCO) in the polishing layer composition. The window composition was injected into a mold having a width of 1,000 mm, a length of 1,000 mm, and a height of 3 mm and preheated at 90° C. and at a discharge rate of 10 kg/min, and was subjected to a post-curing reaction under a temperature condition of 110° C. to prepare a window. The windows were manufactured such that each thickness satisfied the following Table 1, and the width and height were 60 mm and 20 mm, respectively.

A support layer having a structure in which a non-woven fabric including polyester resin fibers was impregnated with a urethane-based resin and a thickness of 1.4 mm was prepared.

A first through hole was formed so as to pass through a first surface which is a polishing surface of the polishing layer and a second surface which is an opposite surface thereof, and formed in a rectangular parallelepiped shape such that the width and the length of the first through hole were 20 mm and 60 mm, respectively.

Subsequently, after an adhesive film including a thermoplastic urethane-based adhesive was disposed on one surface (third surface) of the support layer, the adhesive film was mutually laminated with the second surface of the polishing layer so as to be brought into contact with the second surface of the polishing layer, and then the laminate was thermally sealed at 140° C. using a pressure roller to form a second adhesive layer having a thickness of about 27(±5) μm. Subsequently, the window was prepared by cutting the lowermost surface of the support layer to form a second through hole that passes through the support layer in the thickness direction and in a region corresponding to the first through hole such that the first through hole were mutually connected to the second through hole, and the second through hole was formed in a rectangular parallelepiped shape such that the width and the length of the second through hole were 14 mm and 52 mm, respectively.

Referring to FIG. 2, since the second through hole 201 was formed smaller than the first through hole 101, the upper portion of the second adhesive layer 40 that was exposed to the outside had a width (W2) of 3 mm as a portion corresponding to the width of the window and a width (W2) of 4 mm as a portion corresponding to the length of the window. A moisture curable adhesive composition including about 97.75(±1.25) wt % of a urethane-based prepolymer polymerized and formed from a monomer component including the aromatic diisocyanate of Chemical Formula 1 and a polyol and about 2.25(±1.25) wt % of the unreacted aromatic diisocyanate of Chemical Formula 1 was applied thereto, and then aged for 2 hours. In this case, the moisture curable adhesive composition was applied using a dispenser equipped with a supply nozzle having a diameter of 100 μm. Subsequently, the window 102 was disposed in the first through hole 101 so as to be supported by the surface to which the moisture curable adhesive composition was applied, and was pressurized with a load of 100 N for 1 second, and then was additionally pressurized with a load of 900 N for 10 seconds. As a result, a first adhesive layer 30 was manufactured in which the width of a portion corresponding to the width of the window was 3 mm and the width of a portion corresponding to the length of the window was 4 mm, and the step between the uppermost surface of the window and the first surface satisfies those described in the following Table 1.

In this case, the first adhesive layer was manufactured so as not to be disposed between the side surface of the window 102 and the side surface of the first through hole 101.

Subsequently, the lowermost surface (fourth surface) of the support layer 20 was pressurized to form a compressed region (CR) in a predetermined region in a direction from the side surface of the second through hole 201 toward the inside of the support layer 20. The lowermost surface was pressurized such that the thickness of the compressed region became 0.48 mm, and the compressed region (CR) was formed so as to have a width of 7.5 mm.

As a result, a polishing pad with a total thickness of 3.4 mm, which included a multi-stage adhesive layer of the first adhesive layer 30 and the second adhesive layer at the lowermost surface of the window, and the compressed region (CR) in the support layer, was manufactured.

Examples 2 to 6

A recessed portion was manufactured, which was processed such that the window was manufactured to have a thickness as shown in the following Table 1, the depth (d2) from the lowermost surface of the window satisfied the following Table 1, respectively, and the area of the plane of the window, that is, the width and the length satisfied 13 mm and 30 mm, respectively. When the window was disposed on the first through hole, the step between the uppermost surface of the window and the first surface was disposed so as to satisfy those in the following Table 1 by varying pressurizing loads, and referring to FIG. 3, a polishing pad was manufactured in the same manner as in Example 1, except that the polishing pad was manufactured such that the first adhesive layer was present between the side surface of the window and the side surface of the first through hole, and the length (L1) thereof satisfied those in the following Table 1, respectively.

Comparative Example 1

When the thickness of the window was manufactured as in the following Table 1 and the window was disposed on the first through hole, the second through hole 201 was formed smaller than the first through hole 101 without application of the moisture curable adhesive composition, so that the window 102 was disposed immediately on the upper portion of the second adhesive layer 40 exposed to the outside, and then pressurized to dispose the window 102 in the first through hole 101 such that the step between the uppermost surface of the window 102 and the polishing surface 11 satisfied the following Table 1.

Instead of an adhesive film including a thermoplastic polyurethane-based adhesive as the second adhesive layer 40, an adhesive film including a pressure sensitive adhesive (PSA) was applied, and the process of thermal sealing at 140° C. using a pressure roller was excluded.

The compressed region (CR) was not manufactured on the lower surface of the support layer 20.

A polishing pad from which the first adhesive layer 30 and the compressed region (CR) were excluded as illustrated in FIG. 9(A) was manufactured by manufacturing a polishing pad in the same manner as in Example 1, except for this.

Comparative Example 2

When the thickness of the window was manufactured as in the following Table 1 and the window was disposed on the first through hole, the second through hole 201 was formed smaller than the first through hole 101 without application of the moisture curable adhesive composition, so that the window 102 was disposed immediately on the upper portion of the second adhesive layer 40 exposed to the outside, and then pressurized to dispose the window 102 in the first through hole 101 such that the step between the uppermost surface of the window 102 and the polishing surface 11 satisfied the following Table 1.

Although a compressed region (CR) was manufactured on the lower surface of the support layer 20, the width and thickness (H2) of the compressed region (CR) in a region corresponding to the lowermost surface of the window 102 were manufactured as shown in the following Table 1, an additional compressed region (CR') was formed in a region corresponding to the outer perimeter of the window 102 on the lower surface of the support layer 20 so as to be distinguished from this, and the width and thickness thereof were manufactured in the same manner as the compressed region (CR). The compressed region (CR) and the additional compressed region (CR') were manufactured so as to be partitioned by a non-compression region (NCR).

A polishing pad formed of another structure was manufactured, in which the first adhesive layer 30 was excluded the compressed region (CR) and the additional compressed region were included, as illustrated in FIG. 9(B) by manufacturing a polishing pad in the same manner as in Example 1, except for this.

Comparative Example 3

The thickness of the window was manufactured as shown in the following Table 1 below, and manufactured such that the step between the polishing surface and the uppermost surface of the window was substantially 0 (zero) except for pressurizing with a load of 100 N for 1 second, and then applying additional pressure with a load of 900 N for 10 seconds in the process of disposing the window, and the compressed region (CR) was not manufactured on the lower surface of the support layer 20.

A polishing pad from which the compressed region (CR) were excluded as illustrated in FIG. 9(C) was manufactured by manufacturing a polishing pad in the same manner as in Example 1, except for this.

Comparative Example 4

When the thickness of the window was manufactured as in the following Table 1 and the window was disposed on the first through hole, the second through hole 201 was formed smaller than the first through hole 101 without application of the moisture curable adhesive composition, so that the window 102 was disposed immediately on the upper portion of the second adhesive layer 40 exposed to the outside, and then pressurized to dispose the window 102 in the first through hole 101 such that the step between the uppermost surface of the window 102 and the polishing surface 11 satisfied the following Table 1.

A polishing pad from which the first adhesive layer 30 was excluded as illustrated in FIG. 9(D) was manufactured by manufacturing a polishing pad in the same manner as in Example 1, except for this.

Evaluation and Measurement

Measurement Example 1: Evaluation of Polishing Layer and Window Surface Hardness Samples were prepared by cutting each polishing layer of the Examples and Comparative Examples into a size of 3 cm×3 cm in each of the horizontal and vertical directions. Samples were prepared by cutting the each window of the Examples and Comparative Examples into a size of 3 cm×3 cm in each of the horizontal and vertical directions. After the sample was stored at a temperature of 25° C. for 12 hours, ShoreD hardness was measured using a hardness tester to obtain surface hardness (S1, S2) in a room temperature dry state. Furthermore, after the window sample was immersed in water at 30° C., water at 50° C., and water at 70° C. for 30 minutes, the Shore D hardness was measured using a hardness tester to determine 30° C. wet hardness (S3), 50° C. wet hardness (S4) and 70° C. wet hardness (S5), respectively. The results are each shown in the following Table 1.

Measurement Example 2: Leakage Test

Each polishing pad of the Examples and Comparative Examples was mounted on the surface plate of a polishing device (CTS AP300), a silicon wafer (TEOS wafer) was mounted on a polishing head, polishing was performed under a rotation speed of the polishing head 87 rpm, a pressurized load of polishing head on the polishing pad 3.5 psi, a rotation speed of the surface plate 93 rpm, an injection flow rate of distilled water (DI water) 200 mL/min, a conditioner (CI 45) rotation speed of 101 rpm, and a conditioner vibrational motion speed of 19 times/min until all the grooves of the polishing pad were worn down, and leakage was confirmed once every hour. Subsequently, when a phenomenon in which condensation occurs on the lowermost surface of the window or water accumulates on a surface plate occurs by confirmation with the naked eye, it was evaluated as 'leakage', and when such a phenomenon does not occur at all, it was evaluated as 'good'. The results of the leakage test are shown in the following Table 1.

Measurement Example 3: Air Leak Test

FIG. 7 schematically illustrates a process of measuring the air leak of the polishing pad. Referring to FIG. 7, the air leak value was derived by positioning and sealing a holder in a region corresponding to the outer perimeter of the window on the lower surface of the support layer with respect to each polishing pad of the Examples and the Comparative Examples, then reducing pressure under a condition of −1 bar for 5 seconds, maintaining and stabilizing the decompression conditions for 10 seconds, and then measuring the amount of change in pressure. The results are shown in the following Table 1.

TABLE 1

| | | Example | | | | | | Comparative Example | | | |
|---|---|---|---|---|---|---|---|---|---|---|---|
| Item | Unit | 1 | 2 | 3 | 4 | 5 | 6 | 1 | 2 | 3 | 4 |
| Polishing pad total thickness | mm | 3.4 | 3.4 | 3.4 | 3.4 | 3.4 | 3.4 | 3.4 | 3.4 | 3.4 | 3.4 |
| Polishing layer thickness (D1) | mm | 2.03 | 2.03 | 2.03 | 2.03 | 2.03 | 2.03 | 2.1 | 2.1 | 2.03 | 2.03 |
| Window thickness (D2) | mm | 2.04 | 2.18 | 2.08 | 2.03 | 2.23 | 2.28 | 2.1 | 2.5 | 2.03 | 2.03 |

TABLE 1-continued

| Item | | | Unit | Example 1 | 2 | 3 | 4 | 5 | 6 | Comparative Example 1 | 2 | 3 | 4 |
|---|---|---|---|---|---|---|---|---|---|---|---|---|---|
| Recess depth (d2) | | | mm | 0 | 0 | 0.6 | 0.55 | 0.65 | 0.85 | 0 | 0.95 | 0 | 0 |
| Polished surface-window uppermost surface step (d3) | | | μm | 100 | 150 | 50 | 0 | 200 | 250 | 0 | 50 | 0 | 0 |
| Second adhesive layer thickness | | | μm | 27 | 27 | 27 | 27 | 27 | 27 | 27 (PSA) | 27 | 27 | 27 |
| First Adhesive layer | Side surface length (L1) | | μm | 4 | 3 | 2 | 1 | 0 | 0 | — | — | 0 | — |
| | Width (W3) | Window width | mm | 3 | 3 | 3 | 3 | 3 | 3 | — | — | 3 | — |
| | | Window length | mm | 4 | 4 | 4 | 4 | 4 | 4 | — | — | 4 | — |
| Support Layer | NCR | Thickness (H1) | mm | 1.4 | 1.4 | 1.4 | 1.4 | 1.4 | 1.4 | 1.4 | 1.4 | 1.4 | 1.4 |
| | CR | Width (CR) | mm | 7.5 | 7.5 | 7.5 | 7.5 | 7.5 | 7.5 | — | 3 | — | 7.5 |
| | | Thickness (H2) | mm | 0.48 | 0.48 | 0.48 | 0.48 | 0.48 | 0.48 | — | 0.48 | — | 0.48 |
| Groove | Depth (d1) | | μm | 460 | 460 | 460 | 460 | 460 | 460 | 460 | 460 | 460 | 460 |
| | Width (w1) | | mm | 0.85 | 0.85 | 0.85 | 0.85 | 0.85 | 0.85 | 0.85 | 0.85 | 0.85 | 0.85 |
| | Pitch (p1) | | mm | 3.0 | 3.0 | 3.0 | 3.0 | 3.0 | 3.0 | 3.0 | 3.0 | 3.0 | 3.0 |
| Shore D Hardness | Polishing surface | Room temperature drying (S1) | — | 56 | 56.3 | 55.7 | 55.9 | 56.8 | 56.2 | 56.8 | 57 | 57.5 | 57.4 |
| | Uppermost surface of window | Wet 30° C. (S3) | — | 62.2 | 61.9 | 62 | 61.8 | 62.5 | 61.5 | 62.5 | 62.3 | 62.7 | 62.2 |
| | | Wet 50° C. (S4) | — | 57.3 | 57.1 | 56.3 | 56.9 | 57.5 | 56.5 | 57.5 | 57.7 | 57.6 | 57.2 |
| | | Wet 70° C. (S5) | — | 53.1 | 52.9 | 52.4 | 53 | 53.5 | 52.7 | 53.5 | 53.6 | 53.4 | 53.3 |
| | | Room temperature drying (S2) | — | 62.2 | 61.8 | 61.5 | 62.4 | 62.5 | 61.7 | 62.5 | 62.7 | 62.5 | 62.6 |
| | \|S1-S2\| | | — | 6.2 | 5.5 | 5.8 | 6.5 | 6 | 5.7 | 5.7 | 5.7 | 5 | 5.2 |
| | \|S2-S3\| | | — | 0 | 0.1 | 0.5 | 0.6 | 0.1 | 0 | 0 | 0.4 | 0.2 | 0.4 |
| | \|S2-S4\| | | — | 4.9 | 4.7 | 5.2 | 5.5 | 5 | 5 | 5 | 5 | 4.9 | 5.4 |
| | \|S2-S5\| | | — | 9.1 | 8.9 | 9.1 | 9.4 | 9.2 | 9 | 9 | 9.1 | 9.1 | 9.3 |
| Leakage test | | | — | Good | Good | Good | Good | Good | Good | Leakage | Leakage | Leakage | Leakage |
| Air leak | | | cc/min | $1.4 \times 10^{-4}$ | $1.3 \times 10^{-4}$ | $2.2 \times 10^{-4}$ | $3.4 \times 10^{-4}$ | $2.4 \times 10^{-4}$ | $1.2 \times 10^{-4}$ | Cannot be measured | $2.1 \times 10^{-2}$ | $3.4 \times 10^{-1}$ | $2.8 \times 10^{-2}$ |

Referring to the results in Table 1, it could be confirmed that in the case of the polishing pads of Examples 1 to 6, a multi-stage adhesive layer of the first adhesive layer and the third adhesive layer is provided between the lowermost surface of the window and the third surface of the support layer while the lowermost surface of the window is supported by the third surface of the support layer, simultaneously, the support layer is provided with a compressed region on a region corresponding to the lowermost surface of the window to show an air leak value of less than 10-2 cc/min, more specifically less than 103 cc/min, showing excellent leakage test results. In contrast, it could be confirmed that the polishing pad of Comparative Example 1 is a polishing pad that does not have a multi-stage adhesive layer structure on the lowermost surface of the window and does not have a compressed region of the support layer, and as a result of a leakage test, an extremely severe leakage occurs, and the air flow rate was too high to set decompression conditions in the air leak measurement, and a very inferior air leak prevention effect was exhibited. Furthermore, it could be confirmed that the polishing pad of Comparative Example 2 does not have a multi-stage adhesive layer structure on the lowermost surface of the window, a compressed region of the support layer is present, but is formed not in a region corresponding to the lowermost surface of the window but in a region corresponding to the outer perimeter of the window, and as a result of a leakage test, leakage occurs, and the polishing pad of Comparative Example 2 shows an amount of change in pressure, which is about 100-fold or more of those of the polishing pads of Examples 1 to 6 even in the air leak measurement results, and thus shows relatively inferior sealability.

As described above, the polishing pad according to an exemplary embodiment is a polishing pad capable of detecting an end point by applying a window, and may function as a process part capable of manufacturing an excellent semiconductor device by applying a multi-stage adhesive layer structure to the lowermost surface of the window, and simultaneously providing a compressed region in a specific region of the support layer to substantially remove a negative element according to the local heterogeneity of a portion into which the window is introduced, that is, the possibility of leakage occurrence, maximally extending the service life of the polishing pad that needs to be replaced after used for a predetermined period of time, and maximizing the leakage prevention effect while the polishing pad is used.

What is claimed is:

1. A polishing pad comprising:

a polishing layer comprising a first surface which is a polishing surface and a second surface which is an opposite surface of the first surface, and comprising a first through hole passing through the first surface and the second surface;

a window disposed in the first through hole; and a support layer disposed on the second surface of the polishing layer, comprising a third surface and a fourth surface which is an opposite surface of the third surface, and comprising a second through hole connected to the first through hole while passing through the third surface and the fourth surface, wherein the second through hole is smaller than the first through hole, a lowermost surface of the window is supported by the third surface, a first adhesive layer is interposed between the lowermost surface of the window and the third surface, a second adhesive layer is interposed between the second surface and the third surface; and between the lowermost surface of the window and the third surface, and the support layer comprises a compressed region (CR) in a region corresponding to the lowermost surface of the window, wherein the first adhesive layer comprises a moisture-cured product of a moisture-curable adhesive composition, and the second adhesive layer comprises a thermoplastic resin, wherein the moisture-curable adhesive composition comprises:

a urethane-based prepolymer formed from a monomer component comprising an aromatic diisocyanate represented by Chemical Formula 1; and a diol having 2 to 10 carbon atoms; and an unreacted aromatic diisocyanate represented by Chemical Formula 1:

[Chemical Formula 1]

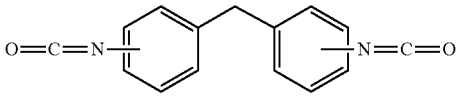

wherein the urethane-based prepolymer is present in an amount of 90 wt % to 99 wt %; and the unreacted aromatic diisocyanate is present in an amount of 1 wt % to 10 wt %, wherein the compressed region is an integrally formed continuous compressed region extending from a side surface of the second through hole toward an interior of the support layer so as to correspond to the lowermost surface of the window, wherein a lowermost surface of the compressed region is closer to the window than the fourth surface, and the compressed region does not include two or more compressed regions having different pressurizing directions in the forming process.

2. The polishing pad of claim 1, wherein the moisture curable adhesive composition has a viscosity of 5,000 mPa·s to 10,000 mPa·s at 20° C. to 30° C.

3. The polishing pad of claim 1, wherein the second adhesive layer comprises an adhesive selected from the group consisting of a thermoplastic urethane-based adhesive, a thermoplastic acrylic adhesive, a thermoplastic silicon-based adhesive, and combinations thereof.

4. The polishing pad of claim 1, wherein the second adhesive layer has a thickness of about 15 μm to about 40 μm.

5. The polishing pad of claim 1, wherein the first adhesive layer is not disposed between a side surface of the first through hole and a side surface of the window.

6. The polishing pad of claim 1, wherein the first adhesive layer is also disposed between a side surface of the first through hole and a side surface of the window.

7. The polishing pad of claim 1, wherein the support layer comprises a non-compression region in a region other than the compressed region, and a percentage of the thickness of the compressed region is 0.01% to 80% with respect to the thickness of the non-compression region.

8. The polishing pad of claim 1, wherein a percentage of the thickness of the compressed region with respect to a width of the compressed region is 0.01% to 30%.

9. The polishing pad of claim 1, wherein the first surface comprises at least one groove, and the groove has a depth of 100 μm to 1500 μm and a width of 0.1 mm to 20 mm.

10. The polishing pad of claim 9, wherein the first surface comprises a plurality of grooves, the plurality of grooves comprise concentric circular grooves, and the concentric circular grooves have a spacing of 2 mm to 70 mm between two adjacent grooves.

11. The polishing pad of claim 1, wherein the lowermost surface of the window comprises a recessed portion.

12. The polishing pad of claim 11, wherein the recessed portion has a depth of 0.1 mm to 2.5 mm.

13. The polishing pad of claim 1, wherein the window comprises a non-foamed cured product of a window composition comprising a first urethane-based prepolymer, and the polishing layer comprises a foamed cured product of a polishing layer composition comprising a second urethane-based prepolymer.

14. The polishing pad of claim 1, wherein a shore D hardness measured at the first surface in a room temperature dry state is smaller than a shore D hardness measured at an uppermost surface of the window in the room temperature dry state.

* * * * *